US010315432B2

(12) United States Patent
Sakai et al.

(10) Patent No.: US 10,315,432 B2
(45) Date of Patent: Jun. 11, 2019

(54) DISCHARGING APPARATUS AND METHOD OF DISCHARGING FLUID

(71) Applicant: Seiko Epson Corporation, Tokyo (JP)

(72) Inventors: Hirofumi Sakai, Shiojiri (JP); Keigo Sugai, Chino (JP); Takahiro Katakura, Okaya (JP); Junichi Sano, Chino (JP); Shinichi Nakamura, Okaya (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 15/704,311

(22) Filed: Sep. 14, 2017

(65) Prior Publication Data

US 2018/0086094 A1 Mar. 29, 2018

(30) Foreign Application Priority Data

Sep. 29, 2016 (JP) ..... 2016-190761

(51) Int. Cl.
*B41J 2/01* (2006.01)
*B41J 2/175* (2006.01)
(Continued)

(52) U.S. Cl.
CPC ..... *B41J 2/17596* (2013.01); *B05C 5/0225* (2013.01); *B41J 2/01* (2013.01); *B41J 2/04588* (2013.01); *B41J 2202/05* (2013.01)

(58) Field of Classification Search
CPC ..... B41J 2/17596; B41J 2/01; B41J 2/04588; B41J 2202/05; B05C 5/0225
See application file for complete search history.

(56) References Cited

U.S. PATENT DOCUMENTS 5,356,034 A 10/1994 Schlumberger
6,060,125 A 5/2000 Fujii
(Continued)

FOREIGN PATENT DOCUMENTS

EP 2 808 093 A1 12/2014
EP 2 842 753 A1 3/2015
(Continued)

OTHER PUBLICATIONS

U.S. Appl. No. 15/703,196, filed Sep. 13, 2017, Hirofumi Sakai et al.
(Continued)

*Primary Examiner* — Yaovi M Ameh
(74) *Attorney, Agent, or Firm* — Harness, Dickey & Pierce, P.L.C.

(57) ABSTRACT

A fluid discharging apparatus includes a storage chamber storing a fluid, a discharge port communicating with the storage chamber, a supply unit supplying the fluid to the storage chamber by pressure, a moving object moving in a first direction toward the discharge port and in a second direction away from the discharge port, a pressure changing mechanism, and a control unit controlling the moving object and the pressure changing mechanism. The control unit performs discharge processing, moving processing, and pressure control processing. In the discharge processing, the moving object moves from a closed position closing the discharge port in the first direction to discharge the fluid. In the moving processing, the moving object moves in the second direction while the fluid is discharged from the discharge port. In the pressure control processing, the pressure changing mechanism suppresses a pressure increase in storage chamber.

6 Claims, 12 Drawing Sheets

(51) Int. Cl.
*B05C 5/02* (2006.01)
*B41J 2/045* (2006.01)

(56) References Cited

U.S. PATENT DOCUMENTS

| | | | | |
|---|---|---|---|---|
| 6,082,629 | A | 7/2000 | Lee et al. | |
| 6,391,111 | B1 | 5/2002 | Fujimoto et al. | |
| 6,527,142 | B1 | 3/2003 | Ikushima | |
| 7,134,617 | B2 | 11/2006 | Ikushima | |
| 7,150,519 | B2 * | 12/2006 | Kono | B41J 2/175 347/85 |
| 9,260,234 | B2 | 2/2016 | Ikushima | |
| 9,440,781 | B2 | 9/2016 | Ikushima | |
| 9,441,617 | B2 | 9/2016 | Kazumasa | |
| 2003/0132243 | A1 | 7/2003 | Engel | |
| 2004/0050974 | A1 * | 3/2004 | Lee | B01L 3/0265 239/537 |
| 2004/0118865 | A1 | 6/2004 | Maruyama et al. | |
| 2004/0134996 | A1 | 7/2004 | Kazumasa | |
| 2009/0071974 | A1 | 3/2009 | Ikushima | |
| 2009/0167818 | A1 | 7/2009 | Morita | |
| 2010/0194803 | A1 | 8/2010 | Ozawa | |
| 2011/0045167 | A1 | 2/2011 | Ikushima | |
| 2014/0217127 | A1 * | 8/2014 | Ikushima | B05C 5/0225 222/420 |
| 2014/0346253 | A1 * | 11/2014 | Ikushima | F04B 17/044 239/337 |
| 2016/0031030 | A1 | 2/2016 | Bergstrom et al. | |
| 2016/0107188 | A1 | 4/2016 | Ikushima | |

FOREIGN PATENT DOCUMENTS

| | | | |
|---|---|---|---|
| JP | H10-227367 | A | 8/1998 |
| JP | 2002-102768 | A | 4/2002 |
| JP | 2002-282740 | A | 10/2002 |
| JP | 2011-031181 | A | 2/2011 |
| JP | 4663894 | B2 | 4/2011 |
| JP | 4711328 | B2 | 6/2011 |
| JP | 5806868 | B2 | 11/2015 |

OTHER PUBLICATIONS

U.S. Appl. No. 15/707,231, filed Sep. 18, 2017, Hirofumi Sakai et al.

Extended European Search Report for Application No. EP 17 19 3485 dated Feb. 7, 2018 (8 pages).

Partial European Search Report for Patent Application No. EP17193496.1 dated Feb. 12, 2018 (15 pages).

* cited by examiner

PROCESS 1

PROCESS 2

PROCESS 3

PROCESS 4

PROCESS 1, PROCESS c

PROCESS 2

PROCESS 3

PROCESS 4, PROCESS d

DISCHARGING APPARATUS AND METHOD OF DISCHARGING FLUID

BACKGROUND

1. Technical Field

The present invention relates to a fluid discharging apparatus and a method of discharging a fluid.

2. Related Art

Various fluid discharging apparatuses that discharge a fluid from a discharge port are proposed. For example, JP-A-2002-282740 discloses a liquid droplet discharging apparatus in which a plunger rod is caused to perform reciprocation in a liquid chamber as an accommodation unit, and thus a liquid is discharged in a form of droplets by extruding the liquid from a discharge port. A discharging mechanism of a fluid, which uses a moving object such a plunger rod in JP-A-2002-282740 may be applied to, for example, an ink jet printer which is a printing device that produces a printout by discharging an ink, or a 3D printer which is a three-dimensional modeling device that models a three-dimensional object by discharging a liquid material.

In the above-described fluid discharging apparatus, after a fluid is discharged, the next fluid may be hindered from being discharged by the fluid which has adhered to a circumference of a discharge port. In the fluid discharging apparatus, a technique of suppressing a fluid from remaining on the circumference of the discharge port after the fluid is discharged may be improved more.

SUMMARY

The invention can be realized as the following aspects.

(1) According to a first aspect of the invention, there is provided a fluid discharging apparatus. The fluid discharging apparatus includes a storage chamber, a discharge port, a supply unit, a moving object, a pressure changing mechanism, and a control unit. The storage chamber stores a fluid. The discharge port communicates with the storage chamber and discharges the fluid. The supply unit supplies the fluid to the storage chamber by pressure. The moving object moves in a first direction toward the discharge port and a second direction away from the discharge port in the storage chamber. The pressure changing mechanism changes pressure of the fluid supplied to the storage chamber or pressure of the fluid in the storage chamber. The control unit controls driving of the moving object and driving of the pressure changing mechanism. The control unit performs discharging processing in which the discharge port is opened by moving the moving object from a closed position at which the discharge port is closed, in the second direction, and then the fluid is extruded and discharged from the discharge port by moving the moving object in the first direction. The control unit performs moving processing in which the moving object is moved in the second direction for a period when the fluid is discharged from the discharge port in the discharging processing. The control unit performs pressure control processing in which an increase in pressure of the storage chamber during the moving processing is suppressed by driving the pressure changing mechanism.

According to the fluid discharging apparatus in this aspect, the moving object is moved in a direction away from the discharge port during a period when the fluid is discharged from the discharge port, and thus a force which acts in a direction in which the fluid is drawn back from the discharge port into the storage chamber can be generated. With the generated force, it is possible to separate a fluid droplet which is required to be scattered toward a target from a fluid which has been extruded from the discharge port, and to bring the remaining fluid back into the storage chamber. Thus, an occurrence of a situation in which a redundant fluid is provided is at a circumferential portion of the discharge port after the fluid is discharged is effectively suppressed. According to the fluid discharging apparatus in this aspect, an occurrence of outflow of a fluid to the discharge port during the moving processing is suppressed by driving the pressure changing mechanism. Thus, the occurrence of a situation in which a redundant fluid is provided is at the circumferential portion of the discharge port after the fluid is discharged is more suppressed.

(2) In the fluid discharging apparatus of this aspect, the pressure changing mechanism may include a supply valve that controls a supply of the fluid to the storage chamber. The control unit may reduce a flow rate of the fluid flowing into the storage chamber by the supply valve in the process of the moving processing being performed, and thus may suppress an increase in pressure if the storage chamber.

According to the fluid discharging apparatus in this aspect, an occurrence of a situation in which pressure in the storage chamber is increased by pressure of supplied fluid by the supply unit in the process of the moving processing being performed is suppressed and an occurrence of a situation in which a redundant fluid flows out from the discharge port is suppressed.

(3) The fluid discharging apparatus of this aspect may further include a buffer room that communicates with the storage chamber and accommodates the fluid. The pressure changing mechanism may change the pressure of the storage chamber by changing a space volume of the buffer room. The control unit may cause the space volume of the buffer room to be increased in the process of the moving processing being performed, so as to suppress an increase in pressure of the storage chamber.

According to the fluid discharging apparatus in this aspect, it is possible to suppress an increase in pressure of the storage chamber and to suppress an occurrence of a redundant fluid flowing out from the discharge port, by moving a portion of the fluid accommodated in the storage chamber to the buffer room in the process of the moving processing being performed.

(4) In the fluid discharging apparatus of this aspect, the control unit may cause the space volume of the buffer room to be reduced in the process of the discharging processing being performed, so as to extrude the fluid to the storage chamber and accelerate flowing of the fluid to the discharge port.

According to the fluid discharging apparatus in this aspect, replenishment of a fluid into a region between the discharge port and the moving object is accelerated when the fluid is discharged from the discharge port. Thus, it is possible to efficiently perform the discharging processing.

(5) The fluid discharging apparatus of this aspect may further include outflow piping which is connected to the storage chamber. The pressure changing mechanism may include a control valve that controls a flow of the fluid in the outflow piping. The control unit may cause the flow rate of the fluid which flows out to the outflow piping to be increased by the control valve in the process of the moving processing being performed, so as to suppress an increase in pressure of the storage chamber.

According to the fluid discharging apparatus in this aspect, a portion of the fluid accommodated in the storage chamber is caused to flow out to the outflow piping through an outflow port in the process of the moving processing being performed. Thus, it is possible to suppress the increase in pressure of the storage chamber and to suppress the occurrence of a situation in which a redundant fluid flows out from the discharge port.

(6) According to a second aspect of the invention, there is provided a method of discharging a fluid from a discharge port which communicates with a storage chamber that stores the fluid. The method includes performing discharging processing in which a discharge port is opened by moving a moving object from a closed position at which the discharge port is closed, in a second direction away from the discharge port in the storage chamber, and then the fluid is extruded and discharged from the discharge port by moving the moving object in a first direction toward the discharge port, performing moving processing in which the moving object is moved in the second direction during a period when the fluid is discharged from the discharge port in the discharging processing, and performing pressure control processing in which a pressure changing mechanism that changes pressure of the fluid supplied to the storage chamber or pressure of the fluid in the storage chamber is driven to suppress an increase in pressure of the storage chamber, which occurs during the moving processing.

According to the fluid discharging apparatus in this aspect, an occurrence of a situation in which a redundant fluid is provided in a circumferential region of the discharge port after the fluid is discharged is efficiently suppressed by movement of the moving object in the moving processing. In addition, the occurrence of a situation in which the redundant fluid flows out from the discharge port during the moving processing is suppressed by the pressure changing mechanism.

All of a plurality of components provided in the above-described aspect of the invention are not necessary. In order to solve some or all of the above-described problems or to achieve some or all of effects described in this specification, appropriately, some of the plurality of components can be changed, removed, or replaced with other new components. In addition, some of limitation details for the components can be deleted. In order to solve some or all of the above-described problems or to achieve some or all of effects described in this specification, some or all of technical features provided in the above-described one aspect of the invention can be combined with some or all of technical features provided in the above-described another aspect of the invention, and the obtained combination can be used as a separate aspect of the invention.

The invention can be realized as various forms other than the fluid discharging apparatus and the method of discharging a fluid. For example, the invention can be realized as a printing device or a three-dimensional modeling device which includes the function of the fluid discharging apparatus, or a system which includes a function equivalent to that of the device, a control method of controlling the device or the system, a computer program for executing a method of discharging a fluid or the above control method, a non-volatile recording medium in which the above computer program is recorded, and the like.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. First Exemplary Embodiment

Figure 1:
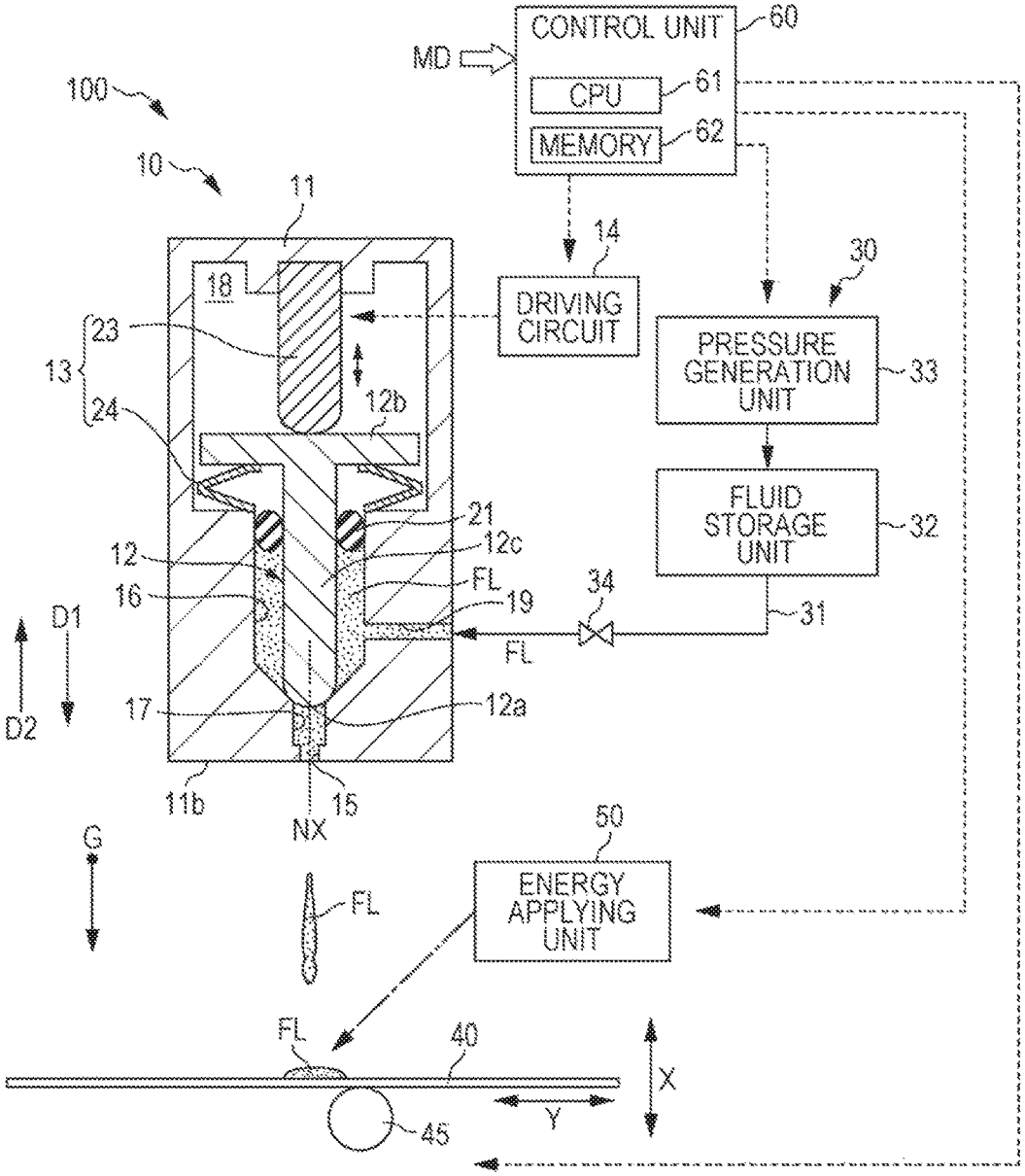
FIG. 1 is a schematic diagram illustrating a configuration of a fluid discharging apparatus in a first exemplary embodiment.

FIG. 1 is a schematic diagram illustrating a configuration of a fluid discharging apparatus 100 in a first exemplary embodiment of the invention. FIG. 1 illustrates an arrow G which indicates a gravity direction (vertical direction) when the fluid discharging apparatus 100 is disposed in a general use state. In this specification, a direction described as "up" or "down" means a direction using the vertical direction as a reference, so long as particular statements are not made. FIG. 1 illustrates arrows which indicate, respectively, a first direction D1 and a second direction D2 which will be described later. The arrows G, D1, and D2 are appropriately illustrated in the drawings referring in this specification.

The fluid discharging apparatus 100 is a 3D printer which is a three-dimensional modeling device. The fluid discharging apparatus 100 models a three-dimensional object by discharging a fluid FL and piling a layer which has been obtained by curing the fluid FL. In this specification, "discharge" means that a fluid is released outwardly from a space in which the fluid is accommodated, by any force including gravity, and has a concept of including "ejection" of releasing a fluid by pressure. A specific example of a fluid FL which is discharged as a material of a three-dimensional object as a modeling target by the fluid discharging apparatus 100 will be described later. The fluid discharging apparatus 100 includes a discharging unit 10, a supply unit 30, a modeling stage 40, a moving mechanism 45, an energy applying unit 50, and a control unit 60.

The discharging unit 10 corresponding to a head unit in a 3D printer and discharges a fluid FL which is a material having fluidity, in a form of a fluid droplet. The "fluid droplet" means a particulate lump of a fluid and means a liquid droplet in a case where the fluid is a liquid. The shape of the fluid droplet is not limited. The shape of the fluid droplet may be spherical or may be a shape in which a spherical shape is extended in one direction, or a shape of, for example, a needle shape or a rod shape. The number of discharged fluid droplets for one discharge is not limited to 1 and a plurality of fluid droplets may be assumed to be discharged. The discharging unit 10 includes an accommodation unit 11, a moving object 12, a driving mechanism 13, and a driving circuit 14.

The accommodation unit 11 is configured as a hollow container and accommodates a fluid FL discharged by the discharging unit 10. In the exemplary embodiment, the accommodation unit 11 has a shape which is substantially cylindrical, and is configured of, for example, stainless steel. A discharge port 15 which functions as a nozzle for discharging the fluid FL is provided in the bottom surface 11*b* of the accommodation unit 11.

The discharge port 15 is provided as a through-hole which communicates with the internal space of the accommodation unit 11 and has an opening section having a substantially circle shape. In the exemplary embodiment, the discharge port 15 is opened in the vertical direction. An opening diameter of the discharge port 15 may be about 10 to 200 μm, for example. The length of the discharge port 15 in the vertical direction may be about 10 to 30 μm, for example.

The accommodation unit 11 includes a storage chamber 16, a pressure chamber 17, and a driving chamber 18. The storage chamber 16 stores the fluid FL. The storage chamber 16 is connected to a flow passage 19 for receiving the fluid FL which is supplied from the supply unit 30 by pressure. The flow passage 19 is configured as a pipeline which penetrates an outer wall of the accommodation unit 11. A tapered portion in which an inclined wall surface which is inclined downwardly toward the discharge port 15 has a diameter which is reduced downwardly is formed at a lower end of the storage chamber 16. The tapered portion may be omitted and the bottom surface of the storage chamber 16 may be configured by a substantially horizontal surface.

The pressure chamber 17 is positioned under the storage chamber 16. The pressure chamber 17 spatially continues to the storage chamber 16 and is opened at the lower end of the storage chamber 16. The discharge port 15 is opened at a lower end of the pressure chamber 17. As will be described later, the pressure chamber 17 is spatially separated from the storage chamber 16 by the moving object 12, when the moving object 12 is disposed at a closed position at which the discharge port 15 is closed. The opening area of the pressure chamber 17 in a section which is perpendicular to an opening direction of the discharge port 15 is greater than the opening area of the discharge port 15, and flow path resistance of the pressure chamber 17 is smaller than the flow path resistance of the discharge port 15.

The driving chamber 18 is positioned over the storage chamber 16 and accommodates the driving mechanism 13. The driving chamber 18 is spatially separated from the storage chamber 16 by a sealing member 21 which will be described later, such that the fluid FL stored in the storage chamber 16 is not entered. Thus, the driving mechanism 13 is protected from the fluid FL.

The moving object 12 is accommodated in the accommodation unit 11. The moving object 12 is disposed over the discharge port 15. In the exemplary embodiment, the moving object 12 is configured by a metal columnar member. The moving object 12 is disposed so as to cause the central axis of the moving object 12 to coincide with the central axis NX of the discharge port 15. The shape of the moving object 12 is not limited to the columnar shape. The moving object 12 may have, for example, a substantially triangular pyramid shape or a substantially spherical shape.

The moving object 12 is disposed over the storage chamber 16 and the driving chamber 18. The tip portion 12*a* of the moving object 12 is accommodated in the storage chamber 16. The rear end portion 12*b* of the moving object is accommodated in the driving chamber 18. In the exemplary embodiment, the tip portion 12*a* of the moving object 12 has a hemispherical shape. The rear end portion 12*b* of the moving object 12 has a substantially disc shape projected in a horizontal direction. The main body portion 12*c* of the moving object 12 between the tip portion 12*a* and the rear end portion 12*b* has a substantially columnar shape. The diameter of the main body portion 12*c* may be about 0.3 to 5 mm, for example.

An annular sealing member 21 which is configured by a resin O-ring is disposed at a boundary between the storage chamber 16 and the driving chamber 18. The main body portion 12*c* of the moving object 12 is inserted into a through-hole at the middle of the sealing member 21. The outer circumferential surface of the sealing member 21 is air-tightly in contact with the inner wall surface of the accommodation unit 11. The inner circumferential surface of the sealing member 21 is air-tightly in contact with the main body portion 12*c* of the moving object 12. Thus, the storage chamber 16 and the driving chamber 18 are spatially separated from each other, as described above.

The moving object 12 is disposed in the storage chamber 16 of the accommodation unit 11, so as to be movable in a first direction D1 toward the discharge port 15 and in a second direction D2 away from the discharge port 15. In the exemplary embodiment, the first direction D1 and the second direction D2 together are parallel to the central axis of the moving object 12 and are parallel to the vertical direction. In the exemplary embodiment, the moving object 12 moves back and forth in the vertical direction. The moving object 12 moves while rubbing the inner circumferential surface of the sealing member 21. In the exemplary embodiment, the moving object 12 moves in a range of about 10 to 500 μm.

When being positioned at the lowest side position, the tip portion 12*a* of the moving object 12 comes into line-contact with the circumferential portion of an opening of the pressure chamber 17 in the storage chamber 16. Thus, the discharge port 15 is closed against the storage chamber 16 and a spatial connection between the storage chamber 16 and the discharge port 15 is cut off. In this specification, the position of the moving object 12 at this time is referred to as "a closed position".

The driving mechanism 13 applies a driving force for movement to the moving object 12. The driving mechanism 13 includes a piezoelectric element 23 and an elastic member 24. The piezoelectric element 23 has a configuration in which a plurality of piezoelectric materials is stacked. The length of the piezoelectric element 23 is changed in a direction in which the piezoelectric materials are stacked, in accordance with the level of a voltage applied to the piezoelectric materials. A voltage is applied to the piezoelectric element 23 from the driving circuit 14.

The upper end portion of the piezoelectric element 23 is fixed to an upper wall surface of the driving chamber 18. The lower end portion of the piezoelectric element 23 is in contact with the rear end portion 12*b* of the moving object 12. The piezoelectric element 23 is stretched and a load is applied to the moving object 12, and thus the moving object 12 moves in the first direction D1.

The elastic member 24 biases the moving object 12 in the second direction D2. In the exemplary embodiment, the elastic member 24 is configured by a disc spring. The elastic member 24 is disposed on a lower side of the rear end portion 12*b* of the moving object 12, so as to surround the main body portion 12*c*. The elastic member 24 applies a force to the rear end portion 12*b* in the second direction. The elastic member 24 may be configured by a helical spring instead of the disc spring. When the piezoelectric element 23 is contracted, the moving object 12 moves in the second direction D2 by the force applied from the elastic member 24, so as to follow the lower end portion of the piezoelectric element 23.

In the discharging unit 10, the moving object 12 moves to reciprocate, and thus fluid droplets of the fluid FL are discharged from the discharge port 15. A discharging mechanism of a fluid droplet in the discharging unit 10 will be described later. In the discharging unit 10, a wall portion which constitutes the bottom surface 11*b* of the accommodation unit 11 and in which the discharge port 15 is not provided may be configured by a member which is detachable from the main body of the accommodation unit 11. The above member is detached from the accommodation unit 11, and thus, for example, cleaning or maintenance of the discharge port 15, replacement or the like when deterioration or damage occurs is easily performed. In addition, replacement with various discharge ports 15 having different opening diameters (nozzle diameters) is possible. Further, in the discharging unit 10, each of the components such as the moving object 12, the sealing member 21, and the elastic member 24, which are accommodated in the accommodation unit 11 may be configured to be detachable from the accommodation unit 11. Thus, maintenance of the discharging unit 10 or replacement of the component is easily performed.

The supply unit 30 supplies the fluid FL to the storage chamber 16 of the accommodation unit 11 through the flow passage 19 by pressure. The supply unit 30 includes piping 31, a fluid storage unit 32, a pressure generation unit 33, and a supply valve 34. The piping 31 connects the flow passage 19 of the accommodation unit 11 and the fluid storage unit 32. The fluid storage unit 32 is a supply source of the fluid FL in the fluid discharging apparatus 100 and is configured by a tank for storing the fluid FL. In the fluid storage unit 32, a solvent is mixed in the stored fluid FL, and thus viscosity of the fluid FL is maintained to be predetermined viscosity. The viscosity of the fluid FL may be about 50 to 40,000 mPa·s, for example.

The pressure generation unit 33 is configured by a pressing pump, for example. The pressure generation unit 33 applies pressure for supplying the fluid FL in the fluid storage unit 32 to the accommodation unit 11 through the piping 31 by pressure. The pressure generation unit 33 applies pressure of, for example, about 0.4 to 0.6 MPa to the fluid FL. In FIG. 1, the pressure generation unit 33 is provided on an upstream side of the fluid storage unit 32. However, the pressure generation unit 33 may be provided on a downstream side of the fluid storage unit 32.

The supply valve 34 is provided on the piping 31, and controls a supply of the fluid FL to the storage chamber of the accommodation unit 11. In the exemplary embodiment, the supply valve 34 is an on-off valve. Thus, when the supply valve 34 is in an open state, flowing of the fluid FL into the storage chamber 16 is permitted. When the supply valve 34 is in a closed state, flowing of the fluid FL into the storage chamber 16 is blocked. The supply valve is configured, for example, by a piezovalve. If the supply valve 34 is configured by a piezovalve, it is possible to obtain high responsiveness. Thus, a delay of a timing of opening and closing the supply valve 34 is suppressed.

The modeling stage 40 is disposed in the front of the opening direction of the discharge port 15 in the discharging unit 10. The discharging unit 10 discharges the fluid FL to the modeling stage 40 as a target object. A three-dimensional object is modeled by fluid droplets of the fluid FL, which have been landed on the modeling stage 40. In the exemplary embodiment, the modeling stage 40 is configured by a member having a flat plate shape, and is disposed substantially horizontally. The modeling stage 40 is disposed at a position which is separate vertically downwardly from the discharge port 15 by about 1.5 to 3 mm, for example.

The moving mechanism 45 includes a motor or a roller, a shaft, and various actuators which are used for displacing the modeling stage 40 with respect to the discharging unit 10. The moving mechanism 45 displaces the modeling stage 40 relatively with respect to the discharging unit 10 in the horizontal direction and in the vertical direction, as represented by both the arrows X and Y in FIG. 1. Thus, the landed position of the fluid FL on the modeling stage 40 is adjusted. The fluid discharging apparatus 100 may have a configuration in which the modeling stage 40 is fixed and the discharging unit 10 is displaced with respect to the modeling stage 40.

The energy applying unit 50 applies energy to the fluid FL landed on the modeling stage 40 so as to cure the fluid FL. In the exemplary embodiment, the energy applying unit 50 is configured by a laser device. The energy applying unit 50 applies light energy to the fluid FL by irradiation with laser. The energy applying unit 50 includes at least a laser light source, a condensing lens, and a galvano mirror (illustrations thereof are omitted). The condensing lens condenses laser emitted from the laser light source on the fluid FL landed on the modeling stage 40. The galvano mirror is used for scanning with laser. The energy applying unit 50 scans a landed position of the fluid droplet on the modeling stage 40 with laser and causes light energy of the laser to sinter the powder material in the fluid FL. Alternatively, the powder material in the fluid FL is melted and combined. Accordingly, a material layer constituting a three-dimensional object is formed on the modeling stage 40.

The energy applying unit 50 may cure the fluid FL by a method other than laser irradiation. The energy applying unit 50 may cure the fluid FL by irradiation with an ultraviolet ray or may remove at least a portion of a solvent of the fluid FL by heating of a heater and cure the powder material.

The control unit 60 is configured by a computer which includes a CPU 61 and a memory 62. The CPU 61 conducts various functions for controlling the fluid discharging apparatus 100 by reading and executing a computer program in the memory 62. The control unit 60 controls each of the discharging unit 10, the supply unit 30, the moving mechanism 45, and the energy applying unit 50 which have been described above, to perform modeling processing for modeling a three-dimensional object.

The control unit 60 receives data MD for modeling a three-dimensional object from an external computer (illustration thereof is omitted) which is connected to the fluid discharging apparatus 100. Data representing each of material layers which are stacked in a height direction of the three-dimensional object is included in the data MD. The control unit 60 determines a timing of discharging fluid droplets of the fluid FL to the discharging unit 10 or the size of the fluid droplet, based on the data MD. The control unit 60 determines a landed position of the fluid droplet of the fluid FL on the modeling stage 40, or a laser irradiation position and an irradiation timing by the energy applying unit 50, based on the data MD. The three-dimensional object modeled on the modeling stage 40 may be obtained through a sintering process in a heating furnace, if necessary.

The control unit 60 transmits a driving signal to the driving circuit 14 in the modeling processing, and thus controls moving of the moving object 12 and causes the fluid FL to be discharged to the discharging unit 10 in the discharging unit 10. The control unit 60 controls an on-off operation of the supply valve 34 when the fluid FL is discharged to the discharging unit 10. Control of the moving object 12 and control of the supply valve 34 by the control unit 60 in the discharging process of discharging the fluid FL will be described later.

With the above configuration, the fluid discharging apparatus 100 in the exemplary embodiment models a three-dimensional object which uses the fluid FL which is a discharging target, as a material. Specific examples of the fluid FL which is the material of the three-dimensional object will be described. In the exemplary embodiment, the fluid FL is a flowable composition which has a paste shape and includes a powder material and a solvent. The fluid FL may include a powder material and a solvent. Examples of the powder material may include single powder of magnesium (Mg), iron (Fe), cobalt (Co), chrome (Cr), aluminium (Al), titanium (Ti), copper (Cu), and nickel (Ni), alloy powder including one kind or more of the above metal (maraging steel, stainless steel, cobalt chromium molybdenum, titanium alloy, nickel alloy, aluminum alloy, cobalt alloy, and cobalt chromium alloy), and mixture powder obtained by mixing one or two kinds or more selected from the single powder or alloy powder. Examples of the solvent of the fluid FL may include water; (poly)alkylene glycol monoalkyl ethers such as ethylene glycol monomethyl ether, ethylene glycol monoethyl ether, propylene glycol monomethyl ether, and propylene glycol monoethyl ether; acetic acid esters such as ethyl acetate, n-propyl acetate, iso-propyl acetate, n-butyl acetate, and iso-butyl acetate; aromatic hydrocarbons such as benzene, toluene, and xylene; ketones such as methyl ethyl ketone, acetone, methyl isobutyl ketone, ethyl-n-butyl ketone, diisopropyl ketone, and acetyl acetone; alcohols such as ethanol, propanol, and butanol; tetraalkyl ammonium acetates; sulfoxide solvents such as dimethyl sulfoxide and diethyl sulfoxide; pyridine solvents such as pyridine, γ-picoline, and 2,6-lutidine; ionic liquids such as tetraalkyl ammonium acetate (for example, tetrabutyl ammonium acetate); and mixtures of one or two kinds or more selected from the above solvents.

The fluid FL may be a mixed material which is obtained by mixing a binder to the powder material and the solvent and has a slurry shape or a paste shape. Examples of the binder may include acrylic resin, epoxy resin, silicone resin, cellulose resin, other synthetic resins, or PLA (polylactic acid), PA (polyamide), PPS (polyphenylene sulfide), other thermoplastic resins. The fluid FL is not limited to a fluid including the powder material. Examples of the fluid FL may include a fluid in which resin such as general-purpose engineering plastics (for example, polyamide, polyacetal, polycarbonate, modified polyphenylene ether, polybutylene terephthalate, and polyethylene terephthalate) is melted. In addition, the fluid FL may be resin such as engineering plastics (for example, polysulfone, polyimide, polyamide imide, polyether imide, and polyether etherketone). The fluid FL may include metal other than the above-described metal, ceramics, resin, or the like. The fluid FL may include a sintering aid.

Figure 2:
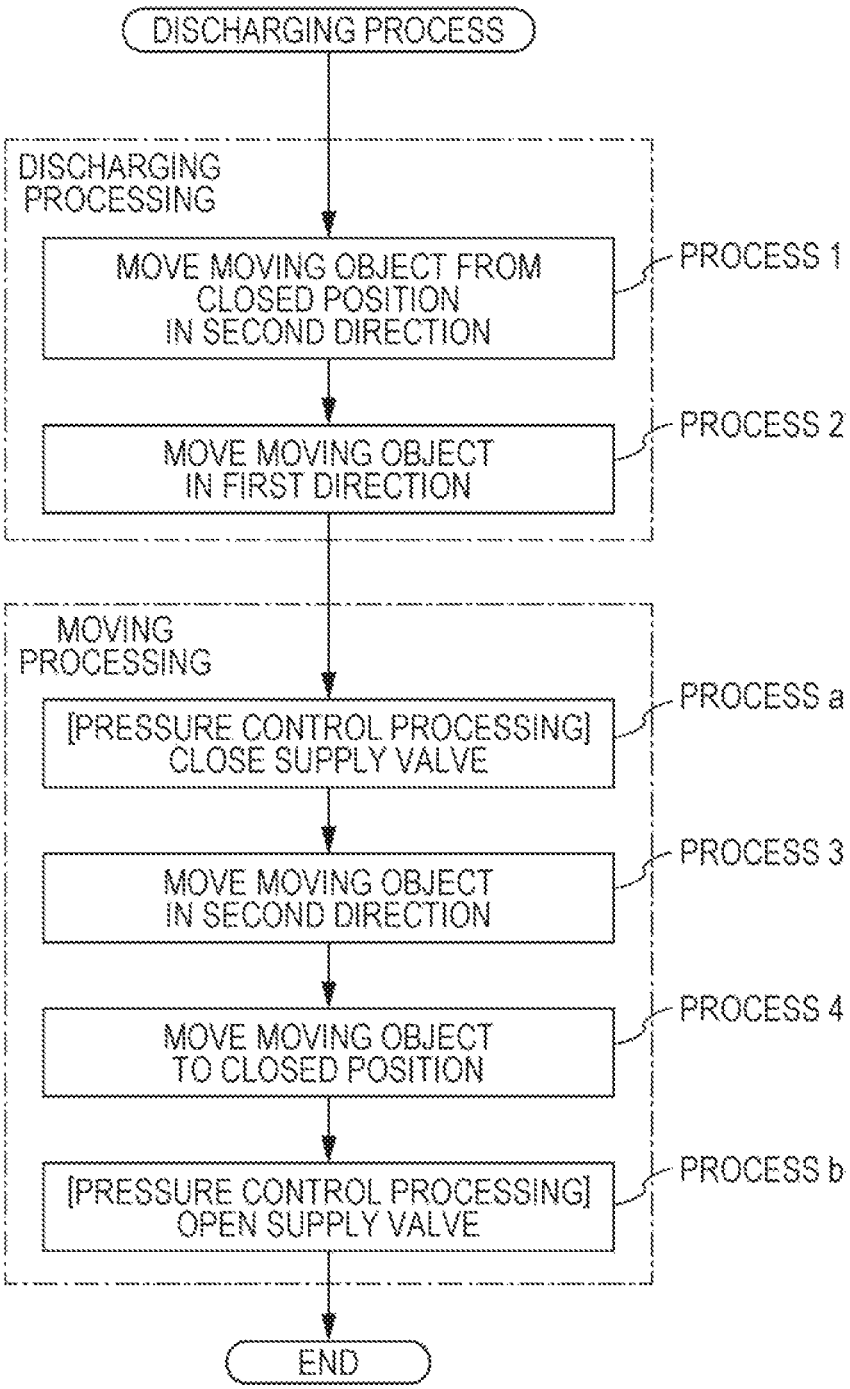
FIG. 2 is a flowchart illustrating a flow of a discharging process in the first exemplary embodiment.
Figure 3:
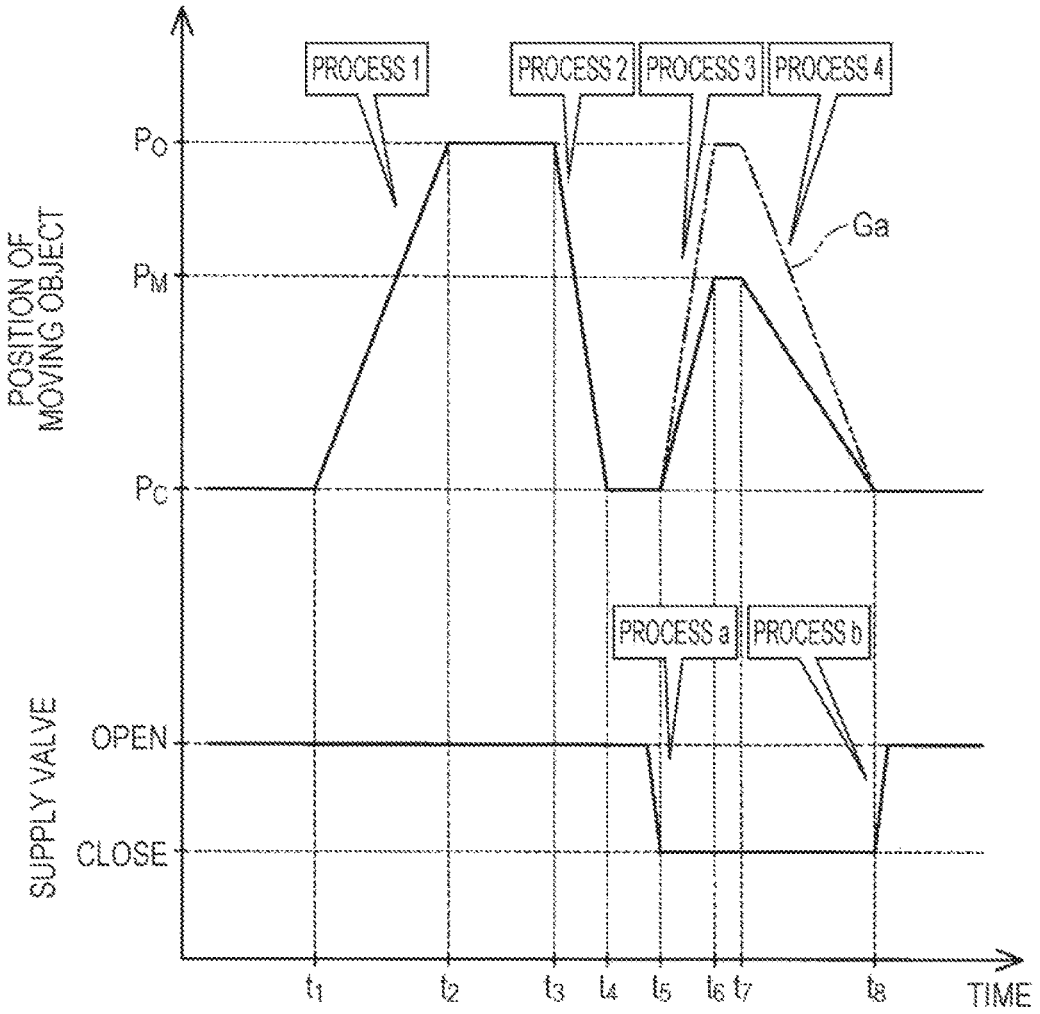
FIG. 3 is a diagram illustrating an example of a timing chart for moving a moving object, and opening and closing a supply valve in the discharging process in the first exemplary embodiment.
Figure 4A:
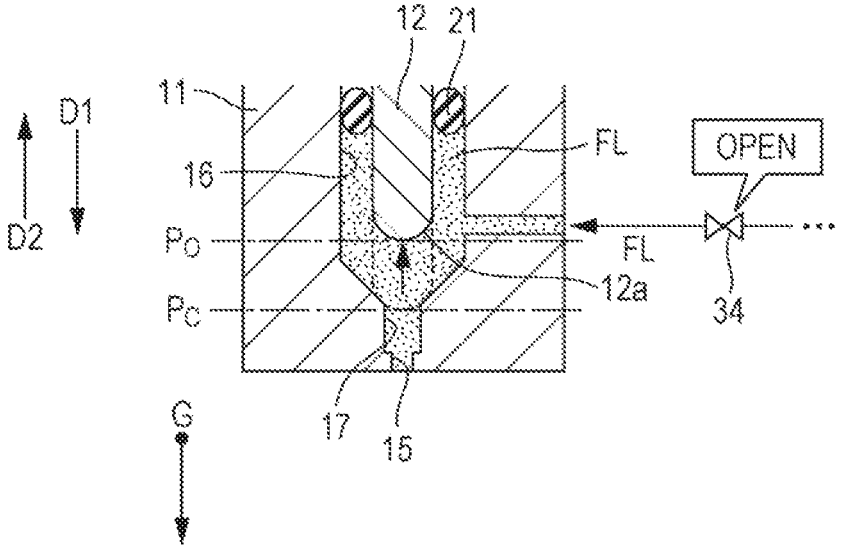
FIG. 4A is a schematic diagram illustrating details of Process 1 in discharging processing in the first exemplary embodiment.
Figure 4B:
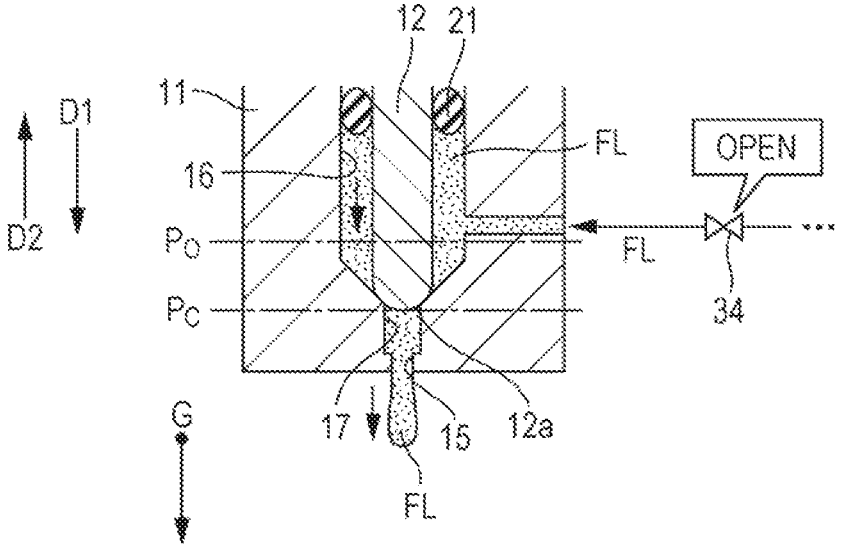
FIG. 4B is a schematic diagram illustrating details of Process 2 in the discharging processing in the first exemplary embodiment.
Figure 5A:
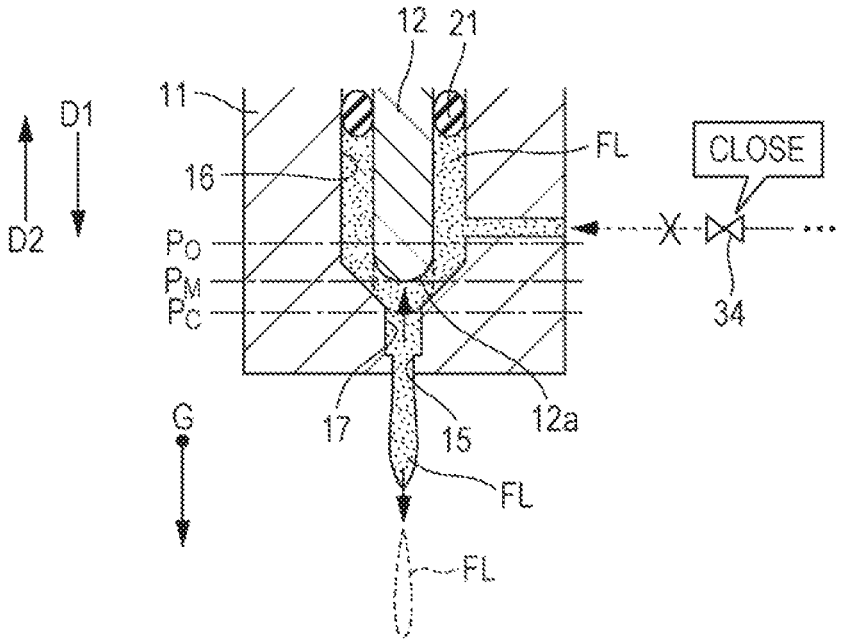
FIG. 5A is a schematic diagram illustrating details of Process 3 in moving processing in the first exemplary embodiment.
Figure 5B:
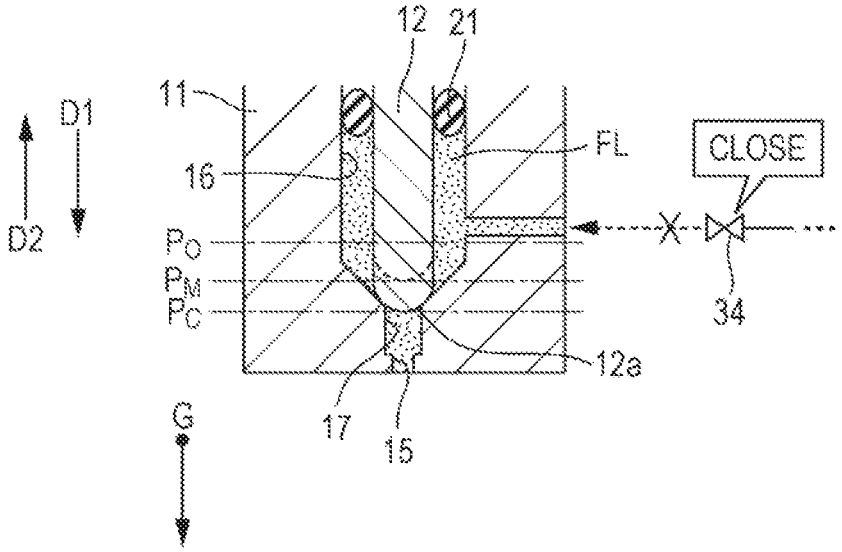
FIG. 5B is a schematic diagram illustrating details of Process 4 in the moving processing in the first exemplary embodiment.

The discharging process of the fluid FL in the fluid discharging apparatus 100 and control of the moving object 12 by the control unit 60 in the discharging process will be described with reference to FIGS. 2 to 5B. FIG. 2 is a flowchart illustrating an example of a flow of the discharging process of the fluid FL. FIG. 3 is a diagram illustrating an example of a timing chart of moving the moving object 12, and opening and closing the supply valve 34 in the discharging process. The position of the moving object 12 in a vertical axis of the timing chart in FIG. 3 corresponds to the level of a voltage applied to the piezoelectric element 23 by the driving circuit 14. FIGS. 4A and 4B are schematic diagrams illustrating details of the discharging processing performed in the discharging process. FIGS. 5A and 5B are schematic diagrams illustrating details of the moving processing performed in the discharging process. Each of FIGS. 4A, 4B, 5A, and 5B illustrates a form of a vicinity region of the discharge port 15 in the accommodation unit 11.

The control unit 60 performs the discharging process of Processes 1 to 4 and Processes a and b in FIG. 2 when a discharging timing of the fluid FL by the discharging unit 10 is reached in the modeling processing. Processes 1 to 4 are processes of control of moving the moving object 12 by the discharging unit 10. Processes a and b are processes of controlling opening and closing of the supply valve 34. If the discharging process is performed one time, fluid droplets of an amount as much as one dot are discharged. Firstly, the control unit 60 sequentially performs Process 1 and Process 2 as the discharging processing.

In Process 1, the control unit 60 controls the driving circuit 14 to apply a voltage to the piezoelectric element 23 and thus causes the piezoelectric element 23 to be contracted (time points $t_1$ to $t_2$ in FIG. 3). Thus, the moving object 12 moves from a closed position $P_C$ at which the discharge port 15 is closed, in the second direction D2. The storage chamber 16 and the pressure chamber 17 are in a state of communicating with each other, and the discharge port 15 is opened (FIG. 4A). At this time, the supply valve 34 maintains an open state, and a supply of the fluid FL to the storage chamber 16 continues so as to cause internal pressure of the storage chamber 16 to be aimed pressure. In Process 1, the moving object 12 reaches an open position $P_O$ which is a position farthest from the discharge port 15 in a moving range of the moving object 12. A moving period (time points $t_1$ to $t_2$) of the moving object 12 in the second direction in Process 1 may be about 50 to 400 μs, for example.

Then, the voltage applied to the piezoelectric element 23 is maintained during a short waiting time (time points $t_3$ to $t_4$ in FIG. 3) which has been predetermined, and the moving object 12 is held at the open position $P_O$. During the period, the fluid FL flows into a region between the tip portion 12*a* of the moving object 12 and the discharge port 15 by using the pressure of the storage chamber 16 as a driving force, and thus the fluid FL is replenished. The waiting time at this time may be appropriately determined in accordance with the viscosity of the fluid FL, pressure applied to the fluid FL by the pressure generation unit 33, the volume of the storage chamber 16, and the like. The waiting time may be about 100 to 300 μs, for example.

In Process 2, the control unit 60 changes the voltage applied to the piezoelectric element 23 by the driving circuit 14 so as to stretch the piezoelectric element 23 (time points $t_3$ to $t_4$ in FIG. 3). Thus, the moving object 12 moves in the first direction D1, the fluid FL is extruded from the discharge port 15 and discharging the fluid FL is started (FIG. 4B). In the exemplary embodiment, in Process 2, the moving object 12 moves to the object 12 knocks on the inner wall surface of the accommodation unit 11, and thus closes the discharge port 15. Thus, flowing of the fluid FL into the pressure chamber 17 and the discharge port 15 can be temporarily blocked. Accordingly, accuracy of adjusting the amount of the discharged fluid FL is improved.

In Process 2, a speed at which the moving object 12 moves in the first direction D1 may be the same as or greater than a speed at which the moving object 12 moves in the second direction D2 in Process 1. In Process 2, a load applied to the moving object 12 from the piezoelectric element 23 may be determined in accordance with aimed pressure of the fluid FL at the discharge port 15 when the fluid FL is discharged from the discharge port 15. For example, in a case where the aimed pressure is about 900 to 1100 MPa, the load applied to the moving object 12 by the piezoelectric element 23 may be about several hundred N.

After discharging the fluid FL from the discharge port 15 is started by Process 2, the control unit 60 starts the moving processing during a period when the fluid FL is discharged from the discharge port 15. The "period when the fluid FL is discharged from the discharge port 15" means a period when the fluid FL is suspended from the discharge port 15 in a columnar shape and does not include a period after the tip portion of the columnar fluid FL is separated as a fluid droplet. That is, the period is a period after discharging of the fluid FL from the discharge port 15 is started and before a fluid droplet of the fluid FL is formed. This period varies depending on the viscosity of the fluid FL, pressure of the fluid FL at the discharge port 15, or the like. The control unit 60 performs Process 2, and then starts the moving processing at an elapsed time point which has been predetermined and at which it is expected that the fluid FL is in a state of being discharged from the discharge port 15. For example, the control unit 60 may start the moving processing after a period of 0.001 to 0.04 s elapses from when Process 2 is performed. The control unit 60 sequentially performs Process a, Processes 3 and 4, and Process b as the moving processing. Process a and Process b are processes of pressure control processing of changing the pressure of the fluid FL supplied to the storage chamber 16.

In Process a, the control unit 60 closes the supply valve 34 and blocks the supply of the fluid FL to the storage chamber 16. It can be interpreted that a state where the supply valve 34 and thus the supply of the fluid FL to the storage chamber 16 by pressure is stopped is a state where the flow rate of the fluid FL is reduced in comparison to that when the supply valve 34 is opened. Subsequently, in Process 3, the control unit 60 controls the driving circuit 14 to apply a voltage to the piezoelectric element 23, and thus causes the piezoelectric element 23 to be contracted again (time points $t_5$ to $t_6$ in FIG. 3). Thus, moving of the moving object 12 in the second direction D2 is started during the period when the fluid FL is discharged from the discharge port 15. In the exemplary embodiment, in Process 3, the moving object 12 moves to an intermediate position $P_M$ between the closed position $P_C$ and the open position $P_O$ (FIG. 5A).

The moving object 12 is moved in the second direction D2 in Process 3, and thus a force from the discharge port 15 into the storage chamber 16 can be generated in the fluid FL discharged from the discharge port 15. Thus, an inertial force and gravity at a time of discharging act on a portion of the fluid FL on a lower end side thereof which is suspended from the discharge port 15, and a force which draws the fluid FL into the accommodation unit 11 acts on a portion of the fluid FL on an upper end side thereof. Accordingly, moving of the moving object 12 in the second direction D2 causes the tip portion of the fluid FL on the lower end thereof which is suspended from the discharge port 15 to be separated as a fluid droplet and fly, as indicated by a broken line in FIG. 5A. It can be interpreted that Process 3 is a process of moving the moving object 12 in the second direction D2 and separating a fluid droplet from a columnar fluid FL. In addition, in Process 3, the moving object 12 moves in the second direction D2, and thus an inertial force in a direction in which the fluid FL is drawn back into the accommodation unit 11 is generated and an occurrence of a situation in which the fluid FL remains at an outer portion of the discharge port 15 is suppressed. In particular, in the exemplary embodiment, the moving object 12 is moved from the closed position $P_C$ in the second direction D2, and thus the force which brings the fluid FL back into the accommodation unit 11 is increased. Further, the occurrence of a situation in which the fluid FL remains at an outer portion of the discharge port 15 is more suppressed.

In Process 3, as illustrated by a graph Ga of a two-dot chain line in FIG. 3, the moving object 12 may be moved to the open position $P_O$. It is desirable that a moving distance of the moving object 12 in Process 3 is the same as or smaller than a moving distance of the moving object 12 in Process 1 (time points $t_1$ to $t_2$). Thus, an occurrence of a situation in which the moving distance of the moving object 12 is wastefully increased is suppressed and efficiency is increased. In particular, if the moving distance of the moving object 12 in Process 3 is smaller than the moving distance of the moving object 12 in Process 1, an occurrence of a situation in which an outer air enters into the accommodation unit 11 from the discharge port 15 in Process 3 is suppressed. It is desirable that a period (time points $t_6$ to $t_7$ in FIG. 3) after Process 3 until Process 4 is started is a period as short as the large amount of the fluid FL does not flow into a region between the tip portion 12*a* of the moving object 12 and the discharge port 15. It is desirable that the period of time points $t_6$ to $t_7$ is a period shorter than the waiting time of the time points $t_2$ to $t_3$. The period may be substantially omitted. Thus, an occurrence of a situation in which the fluid FL is extruded from the discharge port 15 in the next Process 4 is suppressed.

In Process 4, the control unit 60 changes a voltage applied to the piezoelectric element 23 by the driving circuit 14. Thus, the piezoelectric element 23 is stretched and the moving object 12 is brought back to the closed position $P_C$ (time points $t_7$ to $t_8$ in FIG. 3, FIG. 5B). Accordingly, a communication state between the discharge port 15 and the storage chamber 16 is cut off by the moving object 12 and an occurrence of leakage of the fluid FL from the discharge port 15 is suppressed. It is desirable that a speed when the moving object 12 is moved in the first direction D1 in Process 4 is slower than a speed when the moving object 12 is moved in the first direction D1 in Process 2. Thus, an occurrence of a situation in which the fluid FL is discharged from the discharge port 15 by moving the moving object 12 in Process 4 is suppressed. It is possible to relieve an impact when the moving object 12 collides with the inner wall surface of the accommodation unit 11 at the closed position $P_C$, and thus deterioration of the discharging unit 10 is suppressed. If Process 4 is completed, in Process b, the control unit 60 causes the supply valve 34 to be opened and causes the supply of the fluid FL to the storage chamber 16 to be started again. Thus, the internal pressure of the storage chamber 16 is restored.

In the exemplary embodiment, control of moving the moving object 12 in Processes 3 and 4 is performed during a period when the supply valve 34 is closed and transfer of pressure to the storage chamber 16 is blocked. Thus, the increase of the pressure in the storage chamber 16 is suppressed and flowing of the fluid FL to the discharge port 15 in the process of the moving processing being performed is suppressed in comparison to a case where the supply valve is maintained to be closed. Accordingly, at a time of moving processing, an occurrence of a situation in which the fluid FL is leaked from the discharge port 15 is suppressed.

A timing of performing Process a of closing the supply valve 34 may be not ahead of Process 3 and may be the same as a timing when moving of the moving object 12 in the second direction is started in Process 3. The supply valve 34 may be closed during a period when the moving object 12 moves after moving of the moving object 12 in the second direction D2 is started in Process 3. The supply valve 34 may be closed during a short time between Process 3 and Process 4.

A timing of performing Process b in which the supply valve 34 is opened again may be not after performing Process 4 is completed. Process b may be performed during a period when the moving object 12 moves in the first direction after moving of the moving object 12 in the first direction D1 is started. The supply valve 34 may be opened just before the next discharging process is started. It is desirable that the supply valve 34 is opened at a timing at which the internal pressure of the storage chamber 16 can be restored to the predetermined aimed pressure for discharging the fluid FL in a period until the next discharging process.

As described above, according to the fluid discharging apparatus 100 and the method of discharging the fluid FL in the discharging process thereof in the exemplary embodiment, the moving object 12 is moved in the second direction D2 during a period when the fluid FL is discharged from the discharge port 15. Thus, separation of a fluid droplet from a columnar fluid FL which is suspended from the discharge port 15 is accelerated. With the moving processing in the discharging process, the redundant fluid FL discharged from the discharge port 15 is brought back into the accommodation unit 11. Thus, the occurrence of a situation in which the fluid FL remains on the outside of the discharge port 15 after the discharging process is suppressed. In addition, the supply valve 34 is closed in the process of the moving processing being performed. Thus, flowing of the fluid FL to the discharge port 15 is suppressed and outflow of the fluid FL from the discharge port 15 is suppressed. Thus, an occurrence of a situation in which the redundant fluid FL is provided in the circumferential region of the discharge port 15, which includes the discharge port 15, and thus discharging of the next fluid FL is disturbed is suppressed. For example, an occurrence of a situation in which there is a mistake in the amount of the discharged fluid FL in the next discharging process or a situation in which a flying state of a fluid droplet of the fluid FL discharged in the next discharging process is deteriorated is suppressed. Thus, it is possible to smoothly and continuously perform discharging of a fluid droplet of the fluid FL. Since an occurrence of a situation in which the redundant fluid FL adheres to the circumferential region of the discharge port 15 is suppressed, it is possible to reduce the number of times of performing cleaning processing of the circumferential region of the discharge port 15, and efficiency is increased.

Furthermore, according to the fluid discharging apparatus 100 and the method of discharging the fluid FL in the discharging process thereof in the exemplary embodiment, it is possible to obtain various advantages described in the above exemplary embodiment.

B. Second Exemplary Embodiment

Figure 6:
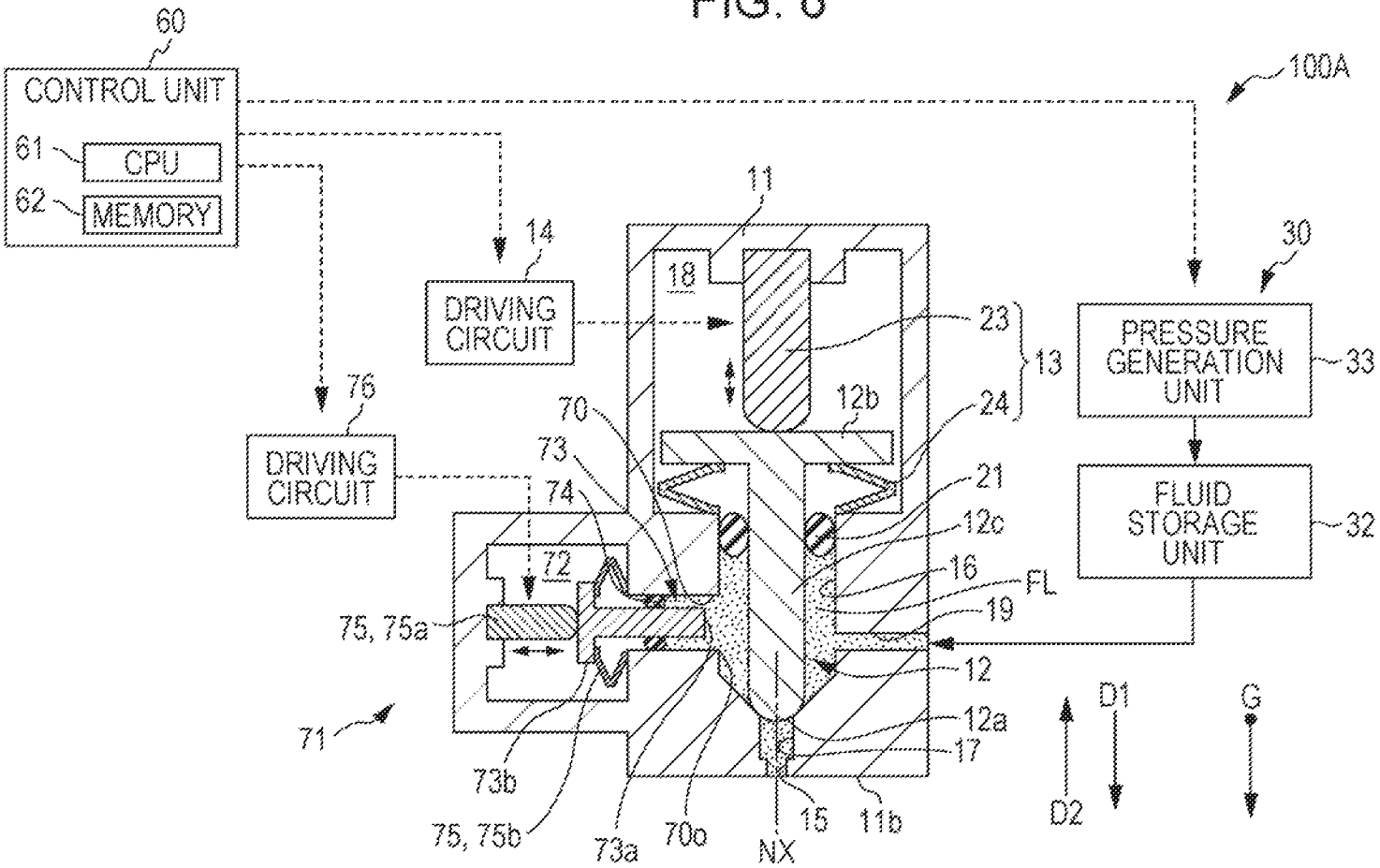
FIG. 6 is a schematic diagram illustrating a configuration of a fluid discharging apparatus in a second exemplary embodiment.

FIG. 6 is a schematic diagram illustrating a configuration of a fluid discharging apparatus 100A in a second exemplary embodiment. The fluid discharging apparatus 100A in the second exemplary embodiment has a configuration which is substantially the same as that of the fluid discharging apparatus 100 (FIG. 1) in the first exemplary embodiment except that the supply unit 30 does not include the supply valve 34, and a buffer room 70 and a control valve mechanism 71 are added. For convenience, in FIG. 6, illustrations of the modeling stage 40, the moving mechanism 45, and the energy applying unit 50 are omitted.

The buffer room 70 communicates with the storage chamber 16 and accommodates the fluid FL flowing out from the storage chamber 16. In the exemplary embodiment, the buffer room 70 is provided at a position which is adjacent to the storage chamber 16, in the accommodation unit 11. The buffer room 70 communicates with the storage chamber 16 through an outflow port 70o which opens in a side wall surface of the storage chamber 16.

The control valve mechanism 71 contracts a valve body 73 in the buffer room 70, and thus controls the amount of the fluid FL accommodated in the buffer room 70 and changes the pressure of the storage chamber 16. The control valve mechanism 71 includes a driving chamber 72, a sealing member 74, a driving mechanism 75, and a driving circuit 76 in addition to the valve body 73. The driving chamber 72 is provided at a position which is adjacent to the buffer room 70, and accommodates the driving mechanism 75 for driving the valve body 73. The valve body 73 is configured by a columnar member. A tip portion 73*a* of the valve body 73 is disposed in the buffer room 70 and a rear end portion 73*b* thereof is disposed in the driving chamber 72.

An annular sealing member 74 which is configured by a resin O-ring is disposed at a boundary between the buffer room 70 and the driving chamber 72. The valve body 73 is inserted into a through-hole at the center of the sealing member 74 and is held. The outer circumferential surface of the sealing member 74 is air-tightly in contact with the inner wall surface of the buffer room 70. The inner circumferential surface of the sealing member 74 is air-tightly in contact with the side surface of the valve body 73. Accordingly, the buffer room 70 and the driving chamber are air-tightly separated from each other, and thus entering of the fluid FL into the driving chamber 72 is suppressed and the driving mechanism 75 is protected.

A driving force is applied to the valve body 73 from the driving mechanism 75 in the driving chamber 72, and thus the valve body 73 moves to reciprocate between the buffer room 70 and the driving chamber 72 while rubbing the inner circumferential surface of the sealing member 74. Thus, the valve body 73 is stretched or contracted in the buffer room 70 and changes the space volume of the buffer room 70. The space volume of the buffer room 70 corresponds to a value obtained by subtracting the volume of the valve body 73 accommodated in the buffer room 70 from the volume of a space surrounded by the sealing member 74 and the inner wall surface of the buffer room 70. The space volume of the buffer room 70 indicates the volume of the fluid FL which can be accommodated in the buffer room 70.

The driving mechanism 75 includes a piezoelectric element 75*a* and an elastic member 75*b*. The piezoelectric element 75*a* has a configuration in which a plurality of piezoelectric materials is stacked. The length of the piezoelectric element 75*a* is changed in a direction in which the piezoelectric materials are stacked, in accordance with the level of a voltage applied to the piezoelectric materials. A voltage is applied to the piezoelectric element 75*a* from the driving circuit 76. The control unit 60 commands the driving circuit 76 to apply a voltage, and thus controls stretching and contraction deformation of the piezoelectric element 75*a*.

One end portion of the piezoelectric element 75*a* in the stacking direction is fixed to a wall surface of the driving chamber 72 and the other end portion thereof is in contact with the rear end portion 73*b* of the valve body 73. Since the piezoelectric element 75*a* is stretched and presses the rear end portion 73*b* of the valve body 73, the valve body 73 moves toward the storage chamber 16, and the length of the valve body 73 which protrudes into the buffer room 70 is extended. The length of the valve body 73 in the buffer room 70 is extended, and thus the space volume of the buffer room 70 is reduced.

The elastic member 75*b* biases the valve body 73 in a direction away from the storage chamber 16. In the exemplary embodiment, the elastic member 75*b* is configured by a disc spring. The rear end portion 73*b* of the valve body 73 has a substantially disc shape and is projected in a diameter direction of the valve body 73. The elastic member 75*b* is disposed on the tip portion 73*a* side from the rear end portion 73*b* of the valve body 73, so as to surround the valve body 73. The elastic member 75*b* is in contact with a projected portion of the rear end portion 73*b*, and thus applies an elastic force to the valve body 73. The elastic member 75*b* may be configured by a helical spring instead of the disc spring.

When the piezoelectric element 75*a* is contracted, the valve body 73 follows the contraction of the piezoelectric element 75*a* and moves in the direction away from the storage chamber 16, by the force applied from the elastic member 75*b*. Thus, the length of the valve body 73 which protrudes into the buffer room 70 is reduced. The length of the valve body 73 in the buffer room 70 is reduced, and thus the space volume of the buffer room 70 is increased.

In a discharging process which will be described below, the control unit 60 controls moving of the moving object 12 in the discharging unit 10, and controls the control valve mechanism 71 with following the moving of the moving object 12 to change the space volume of the buffer room 70. Thus, the fluid FL is caused to flow in a space between the storage chamber 16 and the buffer room 70, and thus the pressure in the storage chamber 16 during the discharging process is changed.

Figure 7:
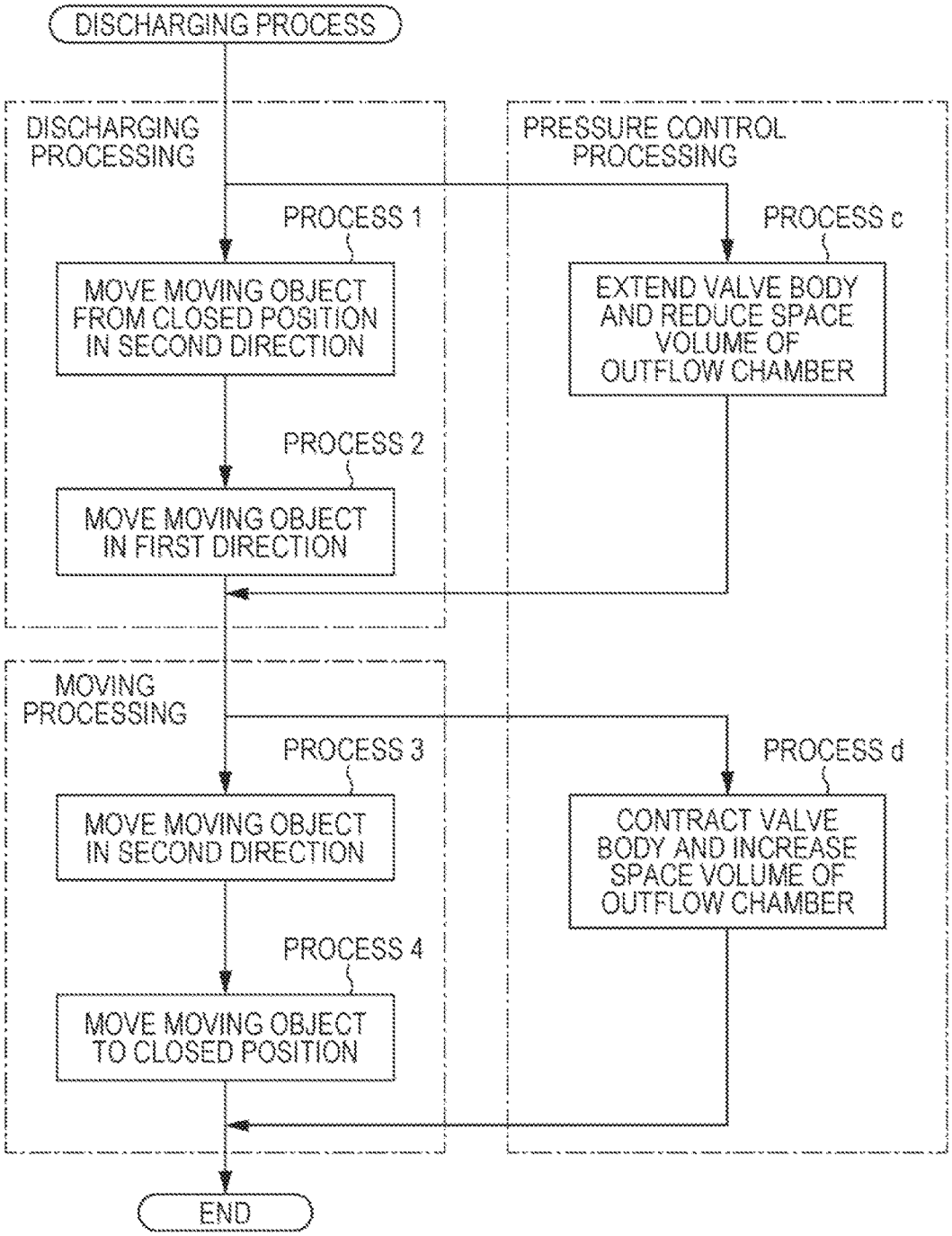
FIG. 7 is a flowchart illustrating a flow of a discharging process in the second exemplary embodiment.
Figure 8:
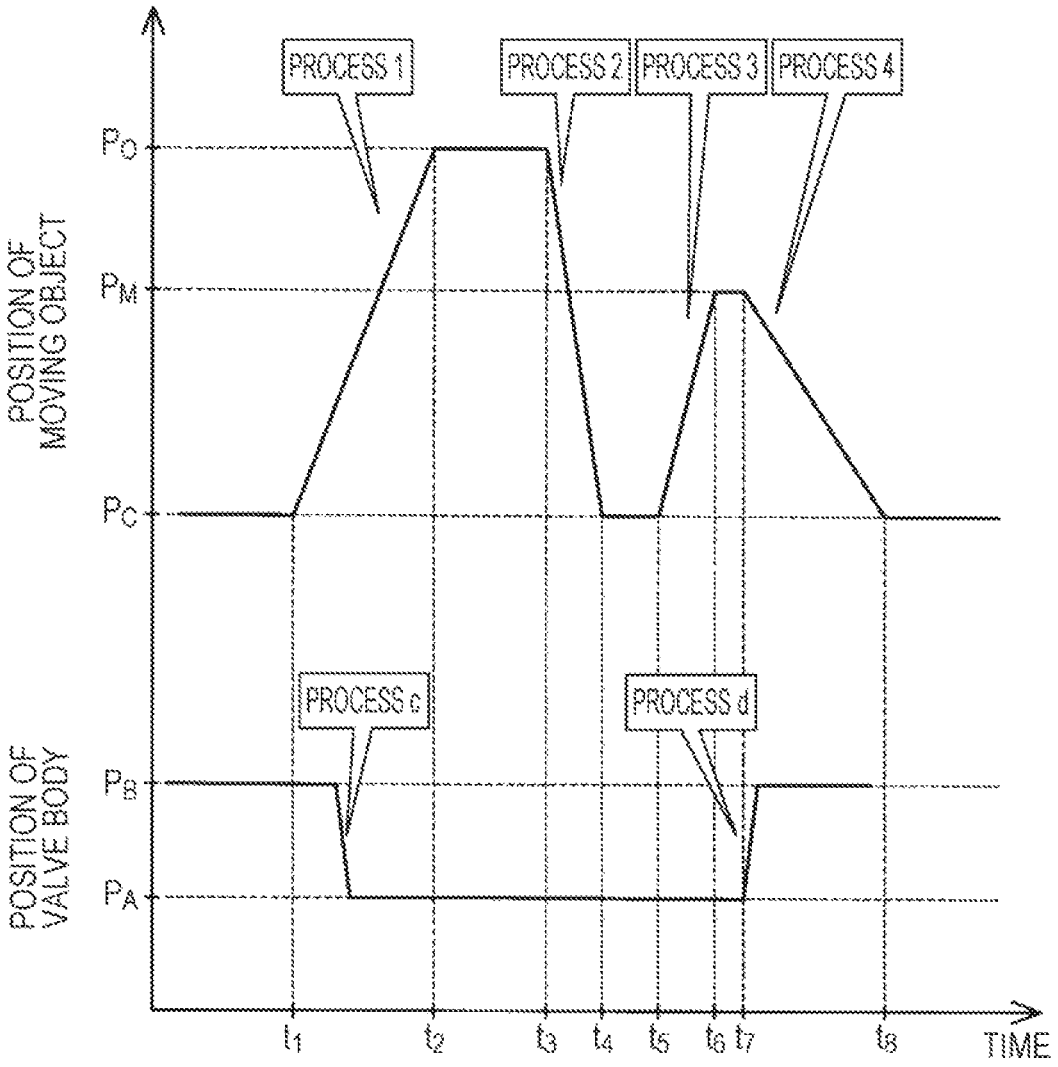
FIG. 8 is a diagram illustrating an example of a timing chart for moving a moving object, and moving a valve body of a control valve mechanism in the discharging process in the second exemplary embodiment.
Figure 9A:
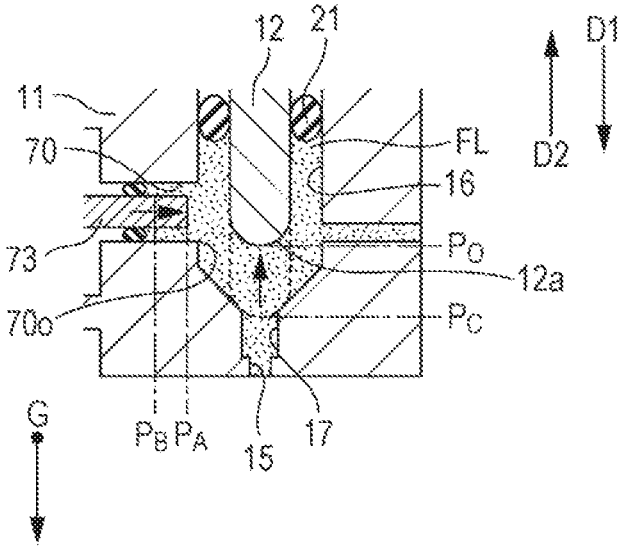
FIG. 9A is a schematic diagram illustrating details of Process 1 and Process c in discharging processing in the second exemplary embodiment.
Figure 9B:
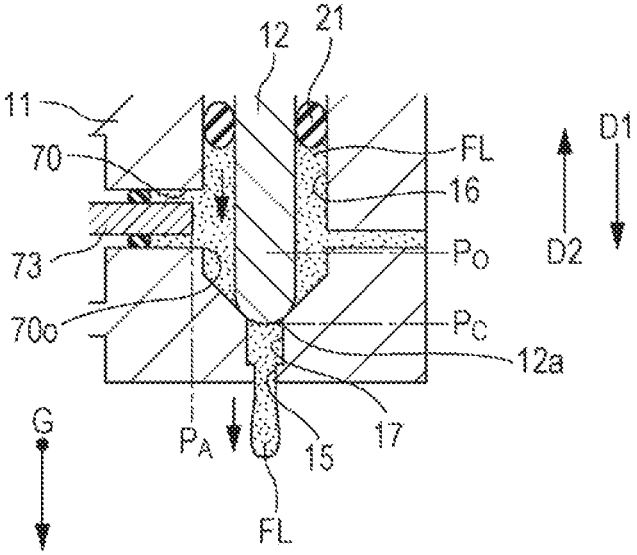
FIG. 9B is a schematic diagram illustrating details of Process 2 in the discharging processing in the second exemplary embodiment.
Figure 10A:
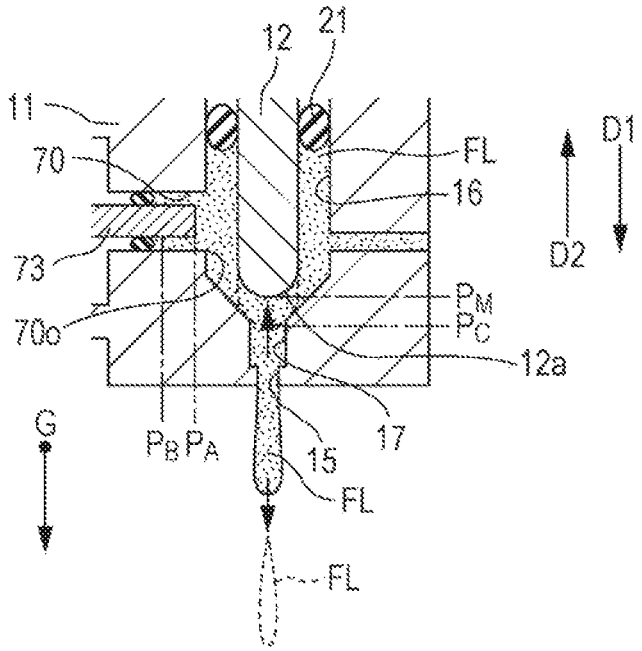
FIG. 10A is a schematic diagram illustrating details of Process 3 in moving processing in the second exemplary embodiment.
Figure 10B:
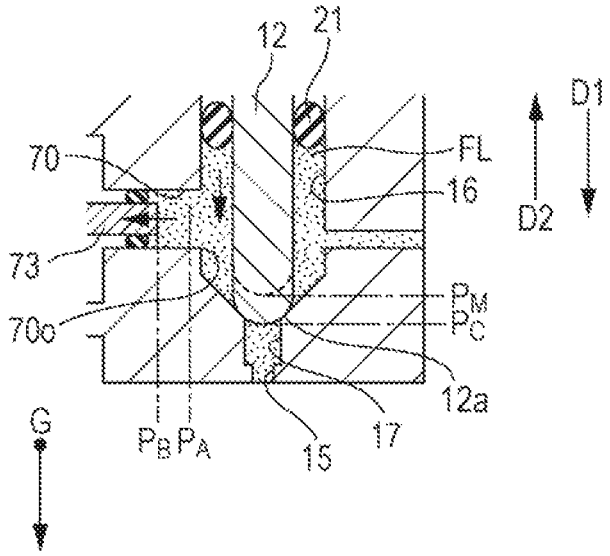
FIG. 10B is a schematic diagram illustrating details of Process 4 and Process d in the moving processing in the second exemplary embodiment.

The discharging process of the fluid FL in the fluid discharging apparatus 100A and control of the control valve mechanism 71 by the control unit 60 in the discharging process will be described with reference to FIGS. 7 to 10B. FIG. 7 is a flowchart illustrating an example of a flow of the discharging process of the fluid FL in the fluid discharging apparatus 100A in the second exemplary embodiment. FIG. 8 is a diagram illustrating an example of a timing chart of moving the moving object 12 of the discharging unit 10 and moving the valve body 73 of the control valve mechanism 71 in the discharging process. The timing chart for the moving object 12 of the discharging unit 10 in FIG. 8 is substantially the same as that in FIG. 3. The position of the valve body 73 in a vertical axis of the timing chart in FIG. 8 corresponds to the level of a voltage applied to the piezoelectric element 75*a* by the driving circuit 76. FIGS. 9A and 9B are schematic diagrams illustrating details of discharging processing performed in the discharging process. FIGS. 10A and 10B are schematic diagrams illustrating details of moving processing performed in the discharging process. Each of FIGS. 9A, 9B, 10A, and 10B illustrates a form of a vicinity region of the discharge port 15 including the buffer room 70.

In the discharging process according to the second exemplary embodiment, in Processes 1 to 4, the control unit performs control of the moving object 12 in a manner similar to Processes 1 to 4 (FIG. 3) described in the first exemplary embodiment. In Processes c and d, the control unit 60 changes the space volume of the buffer room 70 by moving the valve body 73. Process a and Process b are processes of pressure control processing in which the control valve mechanism 71 changes the pressure of the storage chamber 16.

In Process 1, the control unit 60 controls the moving object 12 to be moved from the closed position $P_C$, in the second direction D2 (time points $t_1$ to $t_2$ in FIG. 8, FIG. 9A). After a predetermined waiting time (time points $t_2$ to $t_3$ in FIG. 8), in Process 2, the moving object 12 is moved in the first direction D1 and discharging of the fluid FL from the discharge port 15 is started (time points $t_3$ to $t_4$ in FIG. 8, FIG. 9B).

When the discharging processing of Processes 1 and is started, the valve body 73 of the control valve mechanism 71 is at a position $P_B$ when the valve body 73 is contracted in maximum in the buffer room 70, and the space volume of the buffer room 70 is in the maximum state (time point $t_1$ in FIG. 8). The control unit 60 performs Process c at the timing of performing the above-described Process 1, and the space volume of the buffer room 70 is reduced. In Process c, during Process 1 in which the moving object 12 is moved in the second direction D2, the control unit 60 moves the valve body 73 so as to cause the tip portion 73*a* of the valve body 73 to reach a position $P_A$ which is nearest to the storage chamber 16, and thus the valve body 73 is stretched in the buffer room 70 (time points $t_1$ to $t_2$ in FIG. 8, FIG. 9A). Thus, the space volume of the buffer room 70, and thus it is possible to cause a portion of the fluid FL in the buffer room 70 to flow into the storage chamber 16. In addition, since the fluid FL is replenished in the storage chamber 16 before the fluid FL is discharged from the discharge port 15, it is possible to reduce a time to increase the internal pressure. Process c may be performed during a period of the time points $t_2$ to $t_3$ when the moving object 12 stops at the open position $P_O$, instead of a period of the time points $t_1$ to $t_2$.

In Process 3 of the moving processing, the control unit 60 moves the moving object 12 in the second direction D2 during a period when the fluid FL is discharged from the discharge port 15 (time points $t_5$ to $t_6$ in FIG. 8, FIG. 10A). Thus, a force which acts in a direction in which the fluid FL is drawn back from the discharge port 15 into the storage chamber 16 is generated. Accordingly, a fluid droplet (illustrated with a broken line in FIG. 10A) of the fluid FL is separated and the remaining fluid FL is attracted into the accommodation unit 11. In Process 4, the control unit 60 moves the moving object 12 in the first direction so as to reach the closed position $P_C$, and thus the discharge port 15 is in the closed state.

The control unit 60 performs Process d at the timing of performing the above-described Process 3 in the process of the moving processing being performed. After the control unit 60 starts moving of the moving object 12 in the second direction D2 in Process 3, in Process d, the control unit 60 moves the valve body 73 of the control valve mechanism 71 so as to cause the tip portion 73*a* of the valve body 73 to reach a position $P_B$ which is farthest from the storage chamber 16 (time points $t_7$ to $t_8$ in FIG. 8, FIG. 10B). Thus, the valve body 73 in the buffer room 70 is contracted and the space volume of the buffer room 70 is increased. Therefore, it is possible to move a portion of the fluid FL in the storage chamber 16 to the buffer room 70, and thus an increase of the internal pressure of the storage chamber 16 is suppressed. Accordingly, when the moving object 12 is moved in the first direction D1, it is possible to suppress flowing of the fluid FL to the discharge port 15, and the occurrence of a situation in which a redundant fluid FL is discharged from the discharge port 15 is suppressed.

As described above, according to the fluid discharging apparatus 100A and the method of discharging the fluid FL in the second exemplary embodiment, since the volume of the buffer room 70 which communicates with the storage chamber 16 is increased in the process of the moving processing being performed, flowing of the fluid FL to the discharge port 15 is suppressed. Thus, an occurrence of a situation in which the redundant fluid FL is discharged from the discharge port 15 in the process of the moving processing being performed is suppressed. In addition, according to the fluid discharging apparatus 100A and the method of discharging the fluid FL in the second exemplary embodiment, since the fluid FL is replenished from the buffer room 70 into the storage chamber 16 in the process of the discharging processing being performed, it is possible to reduce a processing time for the discharging processing. Further, according to the fluid discharging apparatus 100A and the method of discharging the fluid FL in the second exemplary embodiment, it is possible to exhibit various effects which are similar to those described in the first exemplary embodiment.

C. Third Exemplary Embodiment

Figure 11:
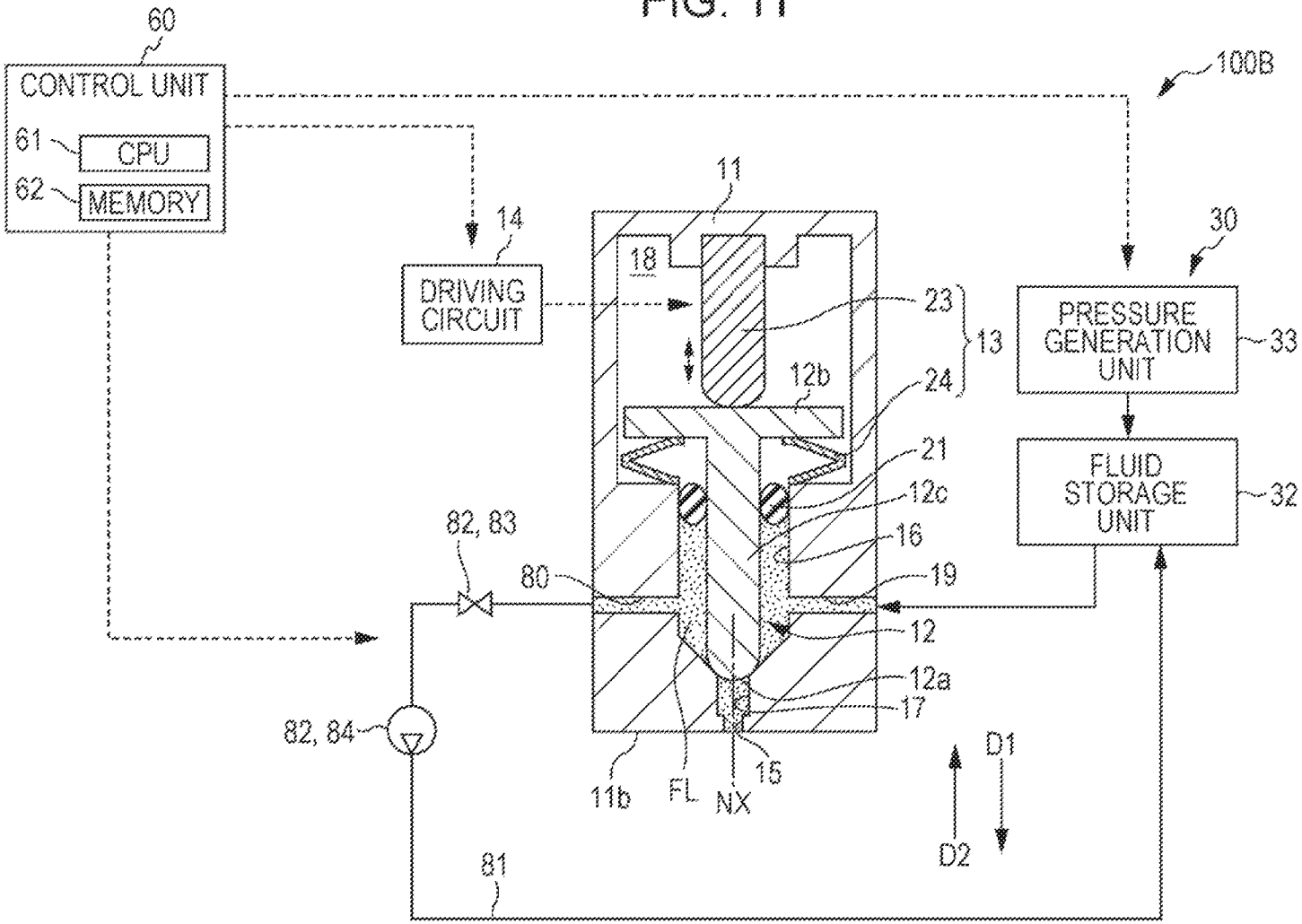
FIG. 11 is a schematic diagram illustrating a configuration of a fluid discharging apparatus in a third exemplary embodiment.

FIG. 11 is a schematic diagram illustrating a configuration of a fluid discharging apparatus 100B in a third exemplary embodiment. The fluid discharging apparatus 100B in the third exemplary embodiment has a configuration which is substantially the same as that of the fluid discharging apparatus 100A (FIG. 6) in the second exemplary embodiment except that a communication passage 80 of the accommodation unit 11, outflow piping 81, and a control valve mechanism 82 are added instead of the buffer room 70 and the control valve mechanism 71. For convenience, similar to FIG. 6, in FIG. 11, the illustrations of the modeling stage 40, the moving mechanism 45, and the energy applying unit 50 are omitted.

In the fluid discharging apparatus 100B in the third exemplary embodiment, the communication passage 80 is provided in the accommodation unit 11. The communication passage 80 is provided as a through-hole which is extended from the outside of the accommodation unit 11 to the storage chamber 16. An outflow port which communicates with the communication passage 80 opens in a wall surface of the storage chamber 16. The communication passage 80 is connected to the fluid storage unit 32 of the supply unit 30 through the outflow piping 81.

The control valve mechanism 82 is provided in the outflow piping 81, and controls the flow of the fluid FL in the outflow piping 81. The control valve mechanism 82 causes the fluid FL to flow out from the storage chamber 16 through the outflow piping 81, and thus changes a pressure state of the storage chamber 16. The control valve mechanism 82 includes a control valve 83 and a pump 84. The control valve 83 is an on-off valve and is opened or closed under control of the control unit 60. The pump 84 is a suction pump which drives under the control of the control unit 60. The pump 84 generates a driving force which causes the fluid FL in the outflow piping 81 to flow from the storage chamber 16 toward the fluid storage unit 32. The pump 84 may be omitted.

Figure 12:
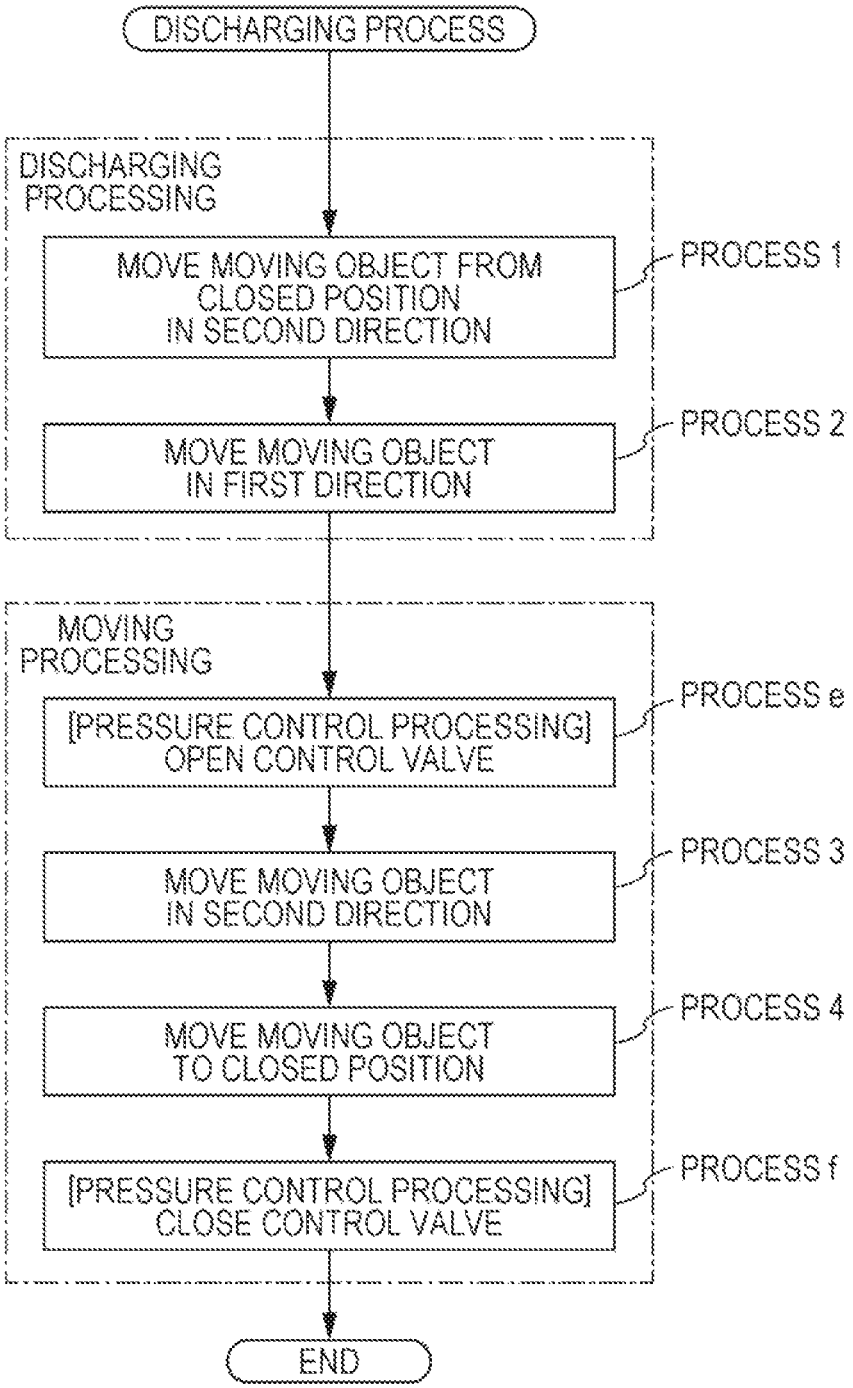
FIG. 12 is a flowchart illustrating a flow of a discharging process in the third exemplary embodiment.

FIG. 12 is a flowchart illustrating an example of a flow of a discharging process in the fluid discharging apparatus 100B in the third exemplary embodiment. In the discharging process, the control unit 60 performs Processes 1 and 2 of discharging processing and Processes 3 and 4 of moving processing a manner similar to that described in the first exemplary embodiment. The control unit 60 performs Processes e and f of controlling the control valve mechanism with control of the moving object 12, in the moving processing. Processes e and f correspond to pressure control processing in which the pressure of the storage chamber 16 is changed by driving the control valve mechanism 82.

The control unit 60 performs Process 1 and Process 2 of the discharging processing, similar to that described in the first exemplary embodiment. The control unit 60 closes the control valve 83 during a period when Process 1 and Process 2 are performed.

In the moving processing, the control unit 60 opens the control valve 83 of the control valve mechanism 82 during a period when the fluid FL is discharged from the discharge port 15, in Process e. The control unit 60 moves the moving object 12 in the second direction D2 in a state where flowing of the fluid FL out into the outflow piping 81 is started, in Process 3. The control unit 60 moves the moving object 12 in the first direction D1 so as to close the discharge port 15 in Process 4. Then, in Process f, the control unit 60 closes the control valve 83 of the control valve mechanism 82. The control unit 60 drives the pump 84 so as to induce the fluid FL which has flowed out into the outflow piping 81, into the fluid storage unit 32.

As described above, since, when the moving processing is performed, the fluid FL in the storage chamber is caused to flow out into the outflow piping 81, the increase of the pressure in the storage chamber 16 during the moving processing is suppressed, and flowing of the fluid FL to the discharge port 15 is suppressed. Thus, the occurrence of a situation in which a redundant fluid FL flows out from the discharge port 15 during the moving processing is suppressed. The fluid FL flowing out into the outflow piping 81 is circulated into the fluid storage unit 32 and is reused. Thus, a wasteful use of the fluid FL is suppressed.

A timing at which the control valve 83 is opened in Process e may be not a timing before moving of the moving object 12 in the second direction D2 in Process 3 is started. The timing at which the control valve 83 is opened may be provided during a period when the moving object 12 moves in Process 3 or may be provided during a period when the moving object 12 moves in the first direction D1 in Process 4. A timing at which the control valve 83 is closed may be not a timing after the discharge port 15 is closed by the moving object 12. The timing at which the control valve 83 may be provided before the discharge port 15 is closed by the moving object 12 or the control valve 83 may be closed just before the next discharging process is started. It is desirable that the control valve 83 is closed at a timing at which the internal pressure of the storage chamber 16 can reach the predetermined aimed pressure in a period until the next discharging process is started.

As described above, according to the fluid discharging apparatus 100B and the method of discharging the fluid FL in the third exemplary embodiment, since the fluid FL in the storage chamber 16 is caused to flow out into the outflow piping 81 during the moving processing, flowing of the fluid FL to the discharge port 15 during the moving processing is suppressed. Thus, an occurrence of a situation in which the redundant fluid FL is discharged from the discharge port 15 in the process of the moving processing being performed is suppressed. In addition, according to the fluid discharging apparatus 100B and the method of discharging the fluid FL in the third exemplary embodiment, since the fluid FL which has flowed out from the outflow piping 81 during the moving processing can be circulated and be reused, efficiency is increased. Further, according to the fluid discharging apparatus 100B and the method of discharging the fluid FL in the third exemplary embodiment, it is possible to exhibit various effects which are similar to those described in the first exemplary embodiment and the second exemplary embodiment.

D. Modification Example

D1. Modification Example 1

The fluid discharging apparatus 100 in the first exemplary embodiment includes the supply valve 34 as the pressure changing mechanism that changes the pressure of the fluid FL supplied to the storage chamber 16. The fluid discharging apparatus 100A in the second exemplary embodiment includes the control valve mechanism 71 that changes the space volume of the buffer room 70, as the pressure changing mechanism that changes the pressure in the storage chamber 16. The fluid discharging apparatus 100B in the third exemplary embodiment includes the control valve mechanism 82 that controls flowing of the fluid FL out from the storage chamber 16 into the outflow piping 81, as the pressure changing mechanism that changes the pressure in the storage chamber 16. On the other hand, the fluid discharging apparatus may include a pressure changing mechanism that changes the pressure of the fluid FL supplied to the storage chamber 16 or the pressure in the storage chamber 16 by using a method which is different from the method described in each of the exemplary embodiments. For example, the fluid discharging apparatus may include a pressure changing mechanism that temporarily branches a portion of the fluid FL from the piping 31 and temporarily reduces the pressure of the fluid FL supplied to the storage chamber 16. The fluid discharging apparatus may include a pressure changing mechanism that changes the pressure in the storage chamber 16 in a manner that the wall surface of the storage chamber 16 is deformed to be bent by an actuator such as a piezoelectric element, and thus the space volume of the storage chamber 16 is changed.

D2. Modification Example 2

In the first exemplary embodiment, the supply valve 34 is configured by an on-off valve. On the other hand, the supply valve 34 may be configured by a flow-rate control valve which can control an opening thereof. In this case, the control unit 60 may reduce the opening of the supply valve 34 and reduce the flow rate of the fluid FL for the storage chamber 16 at a timing which has been described as the timing at which the supply valve 34 is closed in the first exemplary embodiment. The control unit 60 may increase the opening of the supply valve 34 and increase the flow rate of the fluid FL for the storage chamber 16 at a timing which has been described as the timing at which the supply valve 34 opens in the first exemplary embodiment.

D3. Modification Example 3

In the fluid discharging apparatus 100A in the second exemplary embodiment, the valve body 73 is moved to reciprocate by the piezoelectric element 75*a*, and thus the valve body 73 is stretched or contracted in the buffer room 70. On the other hand, in the fluid discharging apparatus 100A in the second exemplary embodiment, the valve body 73 may be moved to reciprocate by the piezoelectric element 75*a*. For example, the valve body 73 may be moved by a solenoid mechanism or the valve body 73 may be moved by using pressure of the air.

D4. Modification Example 4

In the second exemplary embodiment, in the discharging processing of the discharging process, Process c is performed so as to reduce the volume of the buffer room 70 and to cause the fluid FL in the buffer room 70 to flow out into the storage chamber 16. On the other hand, Process c may be not performed in the discharging processing of the discharging process. For example, Process c may be performed in a state where the discharge port 15 is closed after the moving processing is performed.

D5. Modification Example 5

In the second exemplary embodiment, the buffer room is provided at the position which is adjacent to the storage chamber 16. On the other hand, the buffer room 70 may be provided at a position far from the storage chamber 16. The buffer room 70 may communicate with the storage chamber 16 through piping or a pipeline such that the fluid FL in the storage chamber 16 can flow into the buffer room 70.

D6. Modification Example 6

In the second exemplary embodiment, the valve body 73 operates to be stretched or contracted in the buffer room 70, and thus the space volume of the buffer room 70 is increased or decreased and the pressure of the storage chamber 16 is changed. On the other hand, the space volume of the buffer room 70 may be increased or decreased by another method. The space volume of the buffer room 70 may be increased or decreased in a manner that the wall surface of the buffer room 70 is deformed by a piezoelectric element or the like.

D7. Modification Example 7

In the third exemplary embodiment, the control valve 83 is configured by an on-off valve. On the other hand, the control valve 83 may be configured by a flow-rate control valve which can control an opening thereof. In this case, the control unit 60 may reduce the opening of the control valve 83 and reduce the flow rate of the fluid FL out from the storage chamber 16 into the outflow piping 81 at a timing which has been described as the timing at which the control valve 83 is closed in the third exemplary embodiment. The control unit 60 may increase the opening of the control valve 83 and increase the flow rate of the fluid FL out from the storage chamber 16 into the outflow piping at a timing which has been described as the timing at which the control valve 83 opens in the third exemplary embodiment.

D8. Modification Example 8

In the fluid discharging apparatus 100B in the third exemplary embodiment, the outflow piping 81 is connected to the fluid storage unit 32, and thus the fluid FL which has flowed into the outflow piping 81 is circulated and is reused. On the other hand, the outflow piping 81 may be not connected to the fluid storage unit 32. The fluid FL which has flowed into the outflow piping 81 may be stored in another storage unit.

D9. Modification Example 9

In each of the exemplary embodiments, the control unit 60 moves the moving object 12 to the closed position $P_C$ in Process 2 of the discharging processing. On the other hand, the control unit 60 does not move the moving object 12 to the closed position $P_C$ in Process 2 of the discharging processing, but may stop the moving object 12 at a position ahead of the closed position $P_C$ and may move the moving object 12 in the second direction D2 in Process 3.

D10. Modification Example 10

In each of the exemplary embodiments, the control unit 60 may change a speed of moving the moving object 12 in the middle of each of Processes 1 to 4.

D11. Modification Example 11

The configurations of the exemplary embodiments and the modification examples of the exemplary embodiments may be appropriately combined. For example, the configuration of the buffer room 70 and the control valve mechanism 71 in the second exemplary embodiment may be applied to the fluid discharging apparatus 100 in the first exemplary embodiment. Thus, in the discharging process, the control of the control valve mechanism 71 described in the second exemplary embodiment may be performed in addition to the control of the supply valve 34 described in the first exemplary embodiment. Similarly, the configuration of the outflow piping 81 and the control valve mechanism 82 in the third exemplary embodiment may be applied to the fluid discharging apparatus 100 in the first exemplary embodiment. Thus, in the discharging process, the control of the control valve mechanism 82 described in the third exemplary embodiment may be performed in addition to the control of the supply valve 34 described in the first exemplary embodiment. The outflow piping 81 and the control valve mechanism 82 in the third exemplary embodiment may be applied to the fluid discharging apparatus 100A in the second exemplary embodiment. Thus, in the discharging process, the control of the control valve mechanism 82 described in the third exemplary embodiment may be performed in addition to the control of the control valve mechanism 71 described in the second exemplary embodiment. The configuration of the buffer room 70 and the control valve mechanism 71 in the second exemplary embodiment and the configuration of the outflow piping 81 and the control valve mechanism 82 in the third exemplary embodiment may be applied to the fluid discharging apparatus 100 in the first exemplary embodiment. Thus, in the discharging process, the control of the control valve mechanism 71 described in the second exemplary embodiment and the control of the control valve mechanism 82 described in the third exemplary embodiment may be performed in addition to the control of the supply valve 34 described in the first exemplary embodiment.

D12. Modification Example 12

In each of the exemplary embodiments, the discharging process are performed in the modeling processing of modeling a three-dimensional object. On the other hand, the discharging process may be performed at a time other than the time of the modeling processing. For example, the discharging process may be performed during flushing which is performed for maintenance of the discharging unit 10.

D13. Modification Example 13

In each of the exemplary embodiments, the pressure chamber 17 of the accommodation unit 11 may be omitted. In this case, the tip portion 12*a* of the moving object 12 at the closed position $P_C$ may come into contact with the inner circumferential portion of the discharge port 15 and may directly close the discharge port 15.

D14. Modification Example 14

In each of the exemplary embodiments, the moving object 12 is displaced with applying a load in accordance with stretching or contracting of the piezoelectric element 23. On the other hand, the moving object 12 may be displaced with applying a load by a method other than the method using the piezoelectric element 23. For example, the moving object 12 may be displaced with applying a load by pressure of a gas. In each of the exemplary embodiments, the moving object 12 may be integrated with the piezoelectric element 23. In addition, a configuration in which the tip portion of the piezoelectric element 23 moves to reciprocate in the accommodation unit 11, as the moving object 12 may be made.

D15. Modification Example 15

The fluid discharging apparatus in each of the exemplary embodiments is realized as a three-dimensional modeling device that models a three-dimensional object. On the other hand, the fluid discharging apparatus may be not realized as the three-dimensional modeling device. For example, the fluid discharging apparatus may be realized as an ink jet printer that discharges an ink as the fluid or may be realized as a coating device that discharges a coating material or a working device that discharges an adhesive having fluidity.

D16. Modification Example 16

In each of the exemplary embodiments, some or all of the function and the processing realized by software may be realized by hardware. Some or all of the function and the processing realized by hardware may be realized by software. Various circuits such as an integrated circuit, a discrete circuit, or a circuit module obtained by combining the circuits can be used as the hardware.

The invention is not limited to the exemplary embodiments, the examples, and the modification examples which have been described above, and can be realized with various configuration in a range without departing from the gist of the invention. For example, the technical features in the exemplary embodiments, the examples, and the modification examples, which correspond to the technical features in the form described in the section of the summary can be appropriately replaced or combined in order to solve some or all of the above-described problems or to achieve some or all of the above-described effects. If the technical features thereof are not described as being necessary in this specification, the technical features can be appropriately removed.

The entire disclosure of Japanese Patent Application No. 2016-190761, filed Sep. 29, 2016 is expressly incorporated by reference herein.

What is claimed is:

1. A fluid discharging apparatus comprising:

a storage chamber that stores a fluid;

a discharge port that fluidly communicates with the storage chamber, the discharge port being configured to discharge the fluid;

a supply unit that is configured to supply the fluid to the storage chamber by pressure;

a rod that is configured to move in a first direction toward the discharge port and in a second direction away from the discharge port in the storage chamber;

a pressure changing mechanism that is configured to change pressure of the fluid supplied to the storage chamber or pressure of the fluid in the storage chamber;

a memory that is configured to store computer-readable instructions; and a processor that is configured to execute the computer-readable instructions so as to;

firstly move the rod from a first position to a second position in the second direction, the rod being configured to close the discharge port at the first position, the rod being configured to open the discharge port at the second position;

secondly move the rod from the second position to the first position in the first direction so that the fluid is discharged from the discharge port, the fluid that is emitted outside of the discharge port being in a columnar shape;

thirdly move the rod from the first position to a third position in the second direction while the fluid is in the columnar shape and while the pressure changing mechanism is configured to prevent increasing pressure in the storage chamber so that a state of fluid that exists outside of the discharge port is changed from the columnar shape to a droplet shape when the rod is at the third position; and fourthly move the rod from the third position to the first position in the first direction so that the rod is configured to close the discharge port when the fluid that exists outside of the discharge port is in the droplet shape.

2. The fluid discharging apparatus according to claim 1, wherein the pressure changing mechanism includes a supply valve that is configured to control a supply amount of the fluid to the storage chamber, and the processor is configured to control the supply valve so as to reduce a flow rate of the fluid flowing into the storage chamber so as to prevent increasing pressure in the storage chamber when the processor is configured to perform the thirdly movement of the rod.

3. The fluid discharging apparatus according to claim 1, further comprising:

a buffer room which fluidly communicates with the storage chamber and accommodates the fluid, wherein the pressure changing mechanism is configured to change a space volume of the buffer room so as to change pressure of the storage chamber, and the processor is configured to cause the pressure changing mechanism to increase the space volume of the buffer room so as to prevent increasing pressure in the storage chamber when the processor is configured to perform the thirdly movement of the rod.

4. The fluid discharging apparatus according to claim 3, wherein the processor is configured to cause the pressure changing mechanism to reduce the space volume of the buffer room so as to extrude the fluid to the storage chamber and accelerate flowing of the fluid to the discharge port when the processor is configured to perform the second movement of the rod.

5. The fluid discharging apparatus according to claim 1, further comprising:

an outflow pipe which is connected to the storage chamber, wherein the pressure changing mechanism includes a control valve that is configured to control a flow amount of the fluid in the outflow pipe, and the processor is configured to control the control valve so as to increase a flow rate of the fluid which flows out to the outflow pipe so as to prevent increasing pressure in the storage chamber when the processor is configured to perform the thirdly movement of the rod.

6. A method of discharging a fluid by causing a processor to execute computer-readable instructions stored in a memory, the method comprising executing on the processor the steps of:

preparing a rod in a storage chamber in which a fluid is stored, the rod being configured to move in a first direction toward a discharge port and in a second direction away from the discharge port, the discharge port fluidly communicating with the storage chamber so as to discharge the fluid;

firstly moving the rod from a first position to a second position in the second direction, the rod being configured to close the discharge port at the first position, the rod being configured to open the discharge port at the second position;

secondly moving the rod from the second position to the first position in the first direction so that the fluid is discharged from the discharge port, the fluid that is emitted outside of the discharge port being in a columnar shape;

thirdly moving the rod from the first position to a third position in the second direction while the fluid is in the columnar shape and while the processor is configured to prevent increasing pressure in the storage chamber so that a state of the fluid that exists outside of the discharge port is charged from the columnar shape to a droplet shape when the rod is at the third position; and fourthly moving the rod from the third position to the first position in the first direction so that the rod is configured to close the discharge port when the fluid that exists outside of the discharge port is in the droplet shape.

* * * * *